US005621983A

United States Patent [19]

Lundemann et al.

[11] Patent Number: 5,621,983

[45] Date of Patent: Apr. 22, 1997

[54] APPARATUS AND METHOD FOR DECKELING EXCESS AIR WHEN DRYING A COATING ON A SUBSTRATE

[75] Inventors: Thomas J. Lundemann, Maplewood; Robert A. Yapel, Oakdale; Roger K. Yonkoski, Woodbury, all of Minn.; Brian L. Strobush, Kingwood, Tex.

[73] Assignee: Minnesota Mining and Manufacturing Company, St. Paul, Minn.

[21] Appl. No.: 627,708

[22] Filed: Mar. 29, 1996

[51] Int. Cl.[6] ..... F26B 9/00

[52] U.S. Cl. ..... 34/641; 34/643; 34/460; 34/464

[58] Field of Search ..... 34/460, 461, 463, 34/464, 465, 640, 641, 643; 427/393.5, 412.3

[56] References Cited

U.S. PATENT DOCUMENTS

| | | | |
|---|---|---|---|
| 3,494,048 | 2/1970 | Du Frense . | |
| 3,849,904 | 11/1974 | Villalobos . | |
| 4,051,278 | 9/1977 | Democh . | |
| 4,365,423 | 12/1982 | Arter et al. . | |
| 4,406,388 | 9/1983 | Takashi et al. | 226/7 |
| 4,634,840 | 1/1987 | Yamagishi et al. . | |
| 4,698,914 | 10/1987 | Shu et al. . | |
| 4,785,986 | 11/1988 | Daane et al. | 226/7 |
| 4,872,270 | 10/1989 | Fronheiser et al. . | |
| 4,894,927 | 1/1990 | Ogawa et al. . | |
| 4,999,927 | 3/1991 | Durst et al. . | |
| 5,001,845 | 3/1991 | Norz et al. . | |
| 5,010,659 | 4/1991 | Treleven . | |
| 5,014,447 | 5/1991 | Hagen | 34/641 |
| 5,060,396 | 10/1991 | Hansen . | |
| 5,077,912 | 1/1992 | Ogawa et al. . | |
| 5,105,562 | 4/1992 | Hella et al. | 34/643 |
| 5,136,790 | 8/1992 | Hagen et al. . | |
| 5,147,690 | 9/1992 | Faust et al. . | |
| 5,433,973 | 7/1995 | Wallack et al. . | |

FOREIGN PATENT DOCUMENTS

| | | |
|---|---|---|
| 236186A1 | 5/1986 | Germany . |
| 620766 | 7/1978 | U.S.S.R. . |
| 1276889 | 12/1986 | U.S.S.R. . |

OTHER PUBLICATIONS

"Performance Study of a Laminar Flow Dryer for Applications in Film Coating," Wagner et al., Published Paper from the University of Erlangen–Nürnberg, pp. 182–189.

"Thin Film Drying," *Modern Coating and Drying Technology*, Chapter 7, Cohen, VCH Publishers, NY, 1992, pp. 267–298.

"Cellular Convection in Polymer Coatings—An Assessment," Hansen et al., *Ind. Eng. Chem. Prod. Res. Develop.*, vol. 12, No. 1, 1973, pp. 67–69.

"A Primer on Forming Coatings," Cohen et al., *Chemical Engineering Progress*, Sep. 1990, pp. 30–36.

"Take a Closer Look at Coating Problems," Scriven et al., *Chemical Engineering Progress*, Sep. 1990, pp. 24–29.

*Primary Examiner*—Henry A. Bennett
*Assistant Examiner*—Dinnatia Doster
*Attorney, Agent, or Firm*—Gary L. Griswold; Walter N. Kirn; William K. Weimer

[57] ABSTRACT

An apparatus and method for evaporating a coating solvent from a coating on a first substrate and for minimizing the formation of mottle. A drying oven includes a plurality of air foils positioned adjacent to the second substrate surface. Each of the plurality of air foils have a foil slot through which a stream of drying gas is supplied to the drying oven. The foil slot length is adjusted to not be significantly greater than the first substrate width to minimize air flow over the first and second coating edges which minimizes the creation of mottle.

18 Claims, 13 Drawing Sheets

APPARATUS AND METHOD FOR DECKELING EXCESS AIR WHEN DRYING A COATING ON A SUBSTRATE

FIELD OF THE INVENTION

The present invention relates to methods for drying coatings on a substrate and more particularly to methods for drying coatings used in making imaging articles.

BACKGROUND OF THE INVENTION

The production of high quality articles, particularly photographic, photothermographic, and thermographic articles, consists of applying a thin film of coating solution onto a continuously moving substrate. Thin films can be applied using a variety of techniques including: dip coating, forward or reverse roll coating, wire-wound coating, blade coating, slot coating, slide coating, and curtain coating (see for example L. E. Scriven; W. J. Suszynski; *Chem. Eng. Prog.* 1990, September, p. 24). Coatings can be applied as single layers or as two or more superposed layers. While it is usually most convenient for the substrate to be in the form of a continuous substrate, it can also be in the form of a succession of discrete sheets.

The initial coating is either a mixture of solvent and solids or a solution and must be dried to obtain the final dried article. While the cost of a coating process is determined by the coating technique, the cost of a drying process is often proportional to the desired line speed (see E. D. Cohen; E. J. Lightfoot; E. B. Gutoff; *Chem. Eng. Prog.* 1990, September, p. 30). The line speed is limited by the capabilities of the oven. To reduce costs, it is desirable that the removal of solvent from the coating be as efficient as possible. This is generally accomplished by transferring heat to the coated article as efficiently as possible. This is often accomplished by increasing the velocity of the drying gas at the coating surface, thereby increasing heat transfer and solvent evaporation and thus drying the coating more quickly. The resulting turbulent air, however, increases the tendency for defect formation.

The process of applying a coating to and drying that coating on a substrate can inherently create defects, including Benard cells, orange peel, and mottle. Benard cells are defects arising from circulatory motion within the coating after it has been applied (see C. M. Hanson; P. E. Pierce; *Cellular Convection in Polymer Coatings—An Assessment,* 12 Ind. Eng. Chem. Prod. Res. Develop. 1973, p. 67).

Orange peel is related to Benard cells. Orange peel is most common in fluid coatings which have a high viscosity to solids ratio. This is due to the tendency of such systems to "freeze in" the topography associated with Benard cells upon loss of relatively small amounts of solvent. The topography can be observed as a small scale pattern of fine spots like the surface of an orange peel. The scale of the pattern is on the order of millimeters and smaller.

Mottle is an irregular pattern or non-uniform density defect that appears blotchy when viewed. This blotchiness can be gross or subtle. The pattern may even take on an orientation in one direction. The scale can be quite small or quite large and may be on the order of centimeters. Blotches may appear to be different colors or shades of color. In black-and-white imaging materials, blotches are generally shades of gray and may not be apparent in unprocessed articles but become apparent upon development. Mottle is usually caused by air movement over the coating before it enters the dryer, as it enters the dryer, or in the dryer (see for example, "*Modern Coating and Drying Technology,*" Eds. E. D Cohen, E. B. Gutoff, VCH Publishers, N.Y., 1992; p. 288).

Mottle is a problem that is encountered under a wide variety of conditions. For example, mottle is frequently encountered when coatings comprising solutions of a polymeric resin in an organic solvent are coated onto webs or sheets of synthetic organic polymer substrates. Mottle is an especially severe problem when the coating solution contains a volatile organic solvent but can also occur to a significant extent even with aqueous coating compositions or with coating compositions using an organic solvent of low volatility. Mottle is an undesirable defect because it detracts from the appearance of the finished product. In some instances, such as in imaging articles, it is further undesirable because it adversely affects the functioning of the coated article.

Substrates that have been coated are often dried using a drying oven which contains a drying gas. The drying gas, usually air, is heated to a suitable elevated temperature and brought into contact with the coating in order to bring about evaporation of the solvent. The drying gas can be introduced into the drying oven in a variety of ways. Typically, the drying gas is directed in a manner which distributes it uniformly over the surface of the coating under carefully controlled conditions that are designed to result in a minimum amount of disturbance of the coated layer. The spent drying gas, that is, drying gas which has become laden with solvent vapor evaporated from the coating, is continuously discharged from the dryer.

Many industrial dryers use a number of individually isolated zones to allow for flexibility in drying characteristics along the drying path. For example, U.S. Pat. No. 5,060,396 describes a zoned cylindrical dryer for removing solvents from a traveling substrate. The multiple drying zones are physically separated, and each drying zone may operate at a different temperature and pressure. Multiple drying zones are desirable because they permit the use of successively lower solvent vapor composition. German Pat. No. DD 236,186 describes the control of humidity and temperature of each drying zone to effect maximum drying at minimum cost. Soviet Pat. No. SU 620766 describes a multistage timber dryer with staged temperature increases that reduce the stress within the timber.

Usually, when multiple zones are present in an oven, they are isolated from one another. The coated substrate is transferred between the zones through a slot. In order to minimize the air and heat flow between zones and to be able to effectively control the drying conditions in each zone, this slot typically has as small a cross-section as possible that will still allow the substrate to pass between zones. However, the adjacent zones are in communication with one another through the slot and thus there is typically a pressure difference between zones. Air flows from one zone to another; and since the dimensions of the slot are small, the air gas velocity is high. Therefore the slots between ovens tend to be sources for mottle defects.

U.S. Pat. No. 4,365,423 discloses an apparatus and method for drying to reduce mottle. FIG. 1 shows an embodiment of this invention. The drying apparatus 2A uses a foraminous shield 4A to protect the liquid coating 6A from air disturbances. The foraminous shield 4A is described to be a screen or perforated plate that sets tip a "quiescent" zone above the substrate promoting uniform heat and mass transfer conditions. The shield 4A is also noted to restrict the extent to which spent drying gas, which is impinged toward the liquid coating 6A, comes in contact with the surface of the coating. This method is reported to be especially advantageous in drying photographic materials, particularly those comprising one or more layers formed from coating compositions that contain volatile organic solvents. This apparatus and method has the limitation that it slows the rate of drying.

U.S. Pat. No. 4,999,927 discloses another apparatus and method for drying a liquid layer that has been applied to a carrier material moving through a drying zone and which contains both vaporizable solvent components and non-vaporizable components. FIG. 2 illustrates this apparatus 2B and method. Drying gas flows in the direction of the carrier material 8B and is accelerated within the drying zone in the direction of flow. In this manner, laminar flow of the boundary layer of the drying gas adjacent to the liquid layer on the carrier material is maintained. By avoiding turbulent air flow, mottle is reduced.

Examples of two other known drying apparatuses and methods are shown in FIGS. 3 and 4. FIG. 3 schematically shows a known drying apparatus 2C in which air flows (see arrows) from one end of an enclosure to the other end. The airflow is shown in FIG. 3 as being parallel and counter to the direction of travel of the coated substrate (i.e., counter-current). Parallel cocurrent airflow is also known.

FIG. 4 schematically shows a known drying apparatus 2D which involves the creation of impingement airflow (see arrows), that is more perpendicular to the plane of the substrate 8D. The impinging air also acts as a means for floating or supporting the substrate through the oven.

U.S. Pat. No. 4,051,278 describes a method for reducing mottle caused by solvent evaporation in the coating zone. Coating a substrate with reduced mottle, such as coating a composition comprising a film-forming material in an evaporable liquid vehicle onto a flexible web or synthetic organic polymer, is achieved by maintaining at least two of the following at a temperature substantially equivalent to the equilibrium surface temperature of the coated layer at the coating zone: (1) the temperature of the atmosphere at the location of coating; (2) the temperature of the coating composition at the location of coating; and (3) the temperature of the substrate at the coating zone. The equilibrium surface temperature is defined as the temperature assumed by the surface of a layer of the coating composition under steady state conditions of heat transfer following evaporative cooling of the layer at the coating zone. After coating, drying of the coated layer is carried out by conventional techniques. This invention includes methods of drying while preventing mottle formation by controlling temperature (i.e., by cooling) at the coating zone and does not address temperature control or mottle formation within the drying oven. Furthermore, this method would be useful only for coatings that cool significantly due to evaporative cooling which subsequently causes mottle.

U.S. Pat. No. 4,872,270 describes a method of drying latex paint containing water and one or more high boiling organic solvents coated onto a carrier film. The process yields a dried paint layer free of blisters and bubble defects. The coated film is passed continuously through a series of at least three drying stages in contact with warm, moderately humid air and more than half of the heat required for evaporation is supplied to the underside of the film. Drying conditions in at least each of the first three stages are controlled to maintain a film temperature profile which causes the water to evaporate at a moderate rate but more rapidly than the organic solvents, thus achieving coalescence of the paint and avoiding the trapping of liquids in a surface-hardened paint layer. Bubble formation is reportedly eliminated by controlling the vapor pressure of the volatile solvent within the film. The formation of mottle occurs due to a different mechanism than blisters and requires different methods for control and elimination.

U.S. Pat. No. 4,894,927 describes a process for drying a moving web coated with a coating composition containing a flammable organic solvent. The web is passed through a closed-type oven filled with an inert gas and planer heaters on top and bottom of the web. The coating surface is reported to be barely affected by movement of the inert drying gases due to the small amounts of gas required. No discussion of the criticality of the gas flow system or of the need to prevent mottle is given.

U.S. Pat. No. 5,077,912 describes a process for drying a continuously traveling web coated with a coating composition containing an organic solvent. The coating is first dried using hot air until the coating is set-to-touch. It is sufficient that the drying conditions, such as temperature and hot air velocity, are adjusted so as to obtain the set-to-touch condition. Set-to-touch corresponds to a viscosity of $10^8$ to $10^{10}$ poise. Residual solvent is then removed using a heated roll. This method is said to reduce drying defects, decrease drying time, and reduce oven size. No discussion on the construction of the oven, methods of drying, or the criticality of the gas flow system and path is given.

U.S. Pat. No. 5,147,690 describes a process and apparatus for drying a liquid film on a substrate which includes a lower gas or air supply system and an upper gas or air supply system. Heated gas on the underside of the substrate forms a carrying cushion for the substrate and at the same time supplies drying energy to the substrate. The exhaust air is carried away through return channels. Slots for the gas supply and return are arranged alternately in the lower gas system. The upper gas or air supply system has a greater width than the lower gas or air supply system. In the upper gas or air supply system, the supply air or gas is diverted by baffles onto the substrate and returned over the substrate web as return air or gas. The upper gas or air supply system is subdivided into sections for the supply air and exhaust air, each section includes two filter plates of porous material.

U.S. Pat. No. 5,433,973 discloses a method of coating a magnetic recording media onto a substrate, wherein the coating is substantially free of Benard cells. The method comprises the steps of: (a) providing a dispersion comprising a polymeric binder, a pigment, and a solvent; (b) coating the dispersion onto the surface of a substrate; (c) drying the dispersion; (d) calculating values comprising $\mu$, $\beta$, and d representing the viscosity, temperature gradient, and wet caliper of the dispersion respectively; and (e) during the course of carrying out steps (a), (b), and (c), maintaining the ratio $$\frac{\beta d^2}{\mu}$$

below a threshold value sufficient to substantially prevent the formation of Benard Cells in the magnetic recording media coating. No discussion of the interior of the drying oven and arrangement of air inlets and exhausts is given.

A number of methods involve the control of the drying gas within the oven. For example, U.S. Pat. No. 5,001,845 describes a control system for an industrial dryer used to remove a flammable solvent or vapors from a traveling web of material. Sensors within each zone measure the oxygen content of the pressurized atmosphere. If the oxygen content exceeds a given limit, an inert gas is added. At the same time, the pressure is maintained within the oven body by releasing excess gas to the atmosphere.

U.S. Pat. No. 5,136,790 describes a method and apparatus for drying a continuously moving web carrying a liquid, wherein the web is passed through a dryer in which the web is exposed to a recirculating flow of heated drying gas. Exhaust gas is diverted and discharged from the recirculating gas flow at a gas velocity which is variable between maximum and minimum levels, and makeup gas is added to the recirculating gas flow at a gas velocity which is also variable between maximum and minimum levels. A process variable is sensed and compared to a selected set point. A first of the aforesaid flow rates is adjusted to maintain the process variable at the selected set point, and a second of the aforesaid flow rates is adjusted in response to adjustments to the first drying gas velocity in order to insure that the first drying gas velocity remains between its maximum and minimum levels. No discussion of the interior of the drying oven and arrangement of air inlets and exhausts is given.

Soviet Pat. No. SU 1,276,889 describes a method for controlling drying gas by controlling the air gas velocity within the oven. In this method, fan speed in one zone is adjusted, controlling the air flow rate, in order to maintain the web temperature at the outlet to a specified temperature. This approach is limited in that increasing the air gas velocity in order to meet a drying specification can lead to mottle.

The physical state of the drying web can also be used to control the drying ovens. For example, in Soviet Pat. No. SU 1,276,889, noted above, the temperature of the web at the outlet of the oven was used to set the air flow rate.

U.S. Pat. No. 5,010,659 describes an infrared drying system for monitoring the temperature, moisture content, or other physical property at particular zone positions along the width of a traveling web, and utilizing a computer control system to energize and control for finite time periods a plurality of infrared lamps for equalizing physical property and drying the web. The infrared drying system is particularly useful in the graphic arts industry, the coating industry and the paper industry, as well as any other applications requiring physical property profiling and drying of the width of a traveling web of material. No discussion of the interior of the drying oven and arrangement of air inlets and exhausts is given.

U.S. Pat. No. 4,634,840 describes a method for controlling the drying temperature in an oven used for heat-treating thermoplastic sheets and films. A broad and continuous sheet or film is uniformly heated in a highly precise manner and with a specific heat profile by using a plurality of radiation heating furnaces, wherein in the interior of each radiation heating furnace, a plurality of rows of heaters are arranged rectangularly to the direction of delivery of the sheet or film to be heated. A thermometer for measuring the temperature of the sheet or film is arranged in the vicinity of an outlet for the sheet or film outside each radiation heating furnace. Outputs of heaters arranged within the radiation heating furnaces located just before the respective thermometers are controlled based on the temperatures detected by the respective thermometers by using a computer.

Two other patents address drying problems, but fail to address the problem of mottle. U.S. Pat. No. 3,849,904 describes the use of a mechanical restriction of air flow at the edge of a web. Adjustable edge deckles are noted as forming a seal with the underside of a fabric allowing for different heating conditions to occur at the edge. This allows the edge of the fabric to be cooled while the remainder of the fabric is heated. This approach, however, is not advantageous when a polymer substrate is used. Possible scratching of the polymer substrate can generate small particulates which can be deposited on the coating. U.S. Pat. No. 3,494,048 describes the use of mechanical means to divert air flow at the edge of the web. Baffles are noted as deflecting air and preventing air from penetrating behind paper in an ink dryer and from lifting the paper from a drum. Keeping the paper on the drum prevents the drying ink from being smeared.

A need exists for a drying apparatus and method which reduces, if not eliminates, one or more coating defects such as mottle and orange peel, yet permits high throughput. In addition to the drying of coatings used to make photothermographic, thermographic, and photographic articles, the need for improved drying apparatus and methods extends to the drying of coatings of adhesive solutions, magnetic recording solutions, priming solutions, and the like.

SUMMARY OF THE INVENTION

The present invention can be used to dry coated substrates, and particularly to dry coated substrates used in the manufacture of photothermographic, thermographic, and photographic articles. More importantly, the present invention can do this without introducing significant mottle and while running at higher web speeds than known drying methods.

One embodiment includes a method for evaporating a coating solvent from a coating on a first substrate surface of a first substrate and minimizing the formation of mottle as the coating solvent is evaporating. The first substrate also has a second substrate surface and a first substrate width. The coating has a first coating edge and an opposite second coating edge on the first substrate. The method includes the step of providing a drying path for a substrate within a drying oven. The drying oven has a plurality of air foils positioned adjacent to the second substrate surface. Each of the plurality of air foils has a foil slot through which a stream of drying gas is supplied to the drying oven. The foil slot has a slot length and a first slot end. Another step includes adjusting the foil slot length to not be significantly greater than the first substrate width to minimize air flow over the first and second coating edges which minimizes the creation of mottle. Another step includes applying the coating onto the first substrate surface of the first substrate to form a first coated substrate. The first substrate has the first substrate width and having a first substrate end. Another step includes transporting the first coated substrate through the drying path.

Another embodiment of the present invention includes a method for evaporating a coating solvent from a coating on a first substrate surface of a substrate and minimizing the formation of mottle as the coating solvent is evaporating. The first substrate also has a second substrate surface and a first substrate width. The coating has a first coating edge and an opposite second coating edge on the first substrate. The method includes the step of providing a drying path for the substrate within a drying oven. The drying oven has a plurality of sources of drying gas impinging on the second substrate surface. The plurality of sources is positioned adjacent to the second substrate surface. Each of the plurality of drying gas sources has a source length. Another step includes adjusting the source length to not be significantly greater than the substrate width to minimize gas flow over the first and second coating edges which minimizes the creation of mottle. Another step includes applying the coating onto the first substrate surface of the substrate to form a coated substrate. Another step includes transporting the coated substrate through the drying path.

Another embodiment of the present invention includes an apparatus for evaporating a coating solvent from a coating on a first substrate surface of a first substrate and minimizing the formation of mottle as the coating solvent is evaporating. The first substrate also has a second substrate surface and a first substrate width. The coating has a first coating edge and an opposite second coating edge on the first substrate. The apparatus includes means for providing a drying path for the first substrate within a drying oven. The drying oven has a plurality of air foils positioned adjacent to the second substrate surface. Each of the plurality of air foils has a foil slot through which a stream of drying gas is supplied to the drying oven. The foil slot has a slot length and a first slot end. The apparatus further includes means for adjusting the foil slot length to not be significantly greater than the substrate width to minimize air flow over the first and second coating edges which minimizes the creation of mottle. The apparatus further includes means for applying the coating onto the first substrate surface to form a coated substrate. The first substrate has the substrate width. The apparatus further includes means for transporting the coated substrate through the drying path.

Another embodiment includes an apparatus for evaporating a coating solvent from a coating on a first substrate surface of a first substrate and minimizing the formation of mottle as the coating solvent is evaporating. The first substrate also has a second substrate surface and a first substrate width. The coating has a first coating edge and an opposite second coating edge on the first substrate. The apparatus includes means for providing a drying path for the first substrate within a drying oven. The drying oven has a plurality of sources of drying gas impinging on the second substrate surface. The plurality of sources is positioned adjacent to the second substrate surface. Each of the plurality of drying gas sources has a source length. The apparatus further includes means for adjusting the source length to not be significantly greater than the substrate width to minimize gas flow over the first and second coating edges which minimizes the creation of mottle. The apparatus further includes means for applying the coating onto the first substrate surface of the first substrate to form a coated substrate. The apparatus further includes means for transporting the coated substrate through the drying path.

As used herein:

"photothermographic article" means a construction comprising at least one photothermographic emulsion layer and any substrates, top-coat layers, image receiving layers, blocking layers, antihalation layers, subbing or priming layers, etc.

"thermographic article" means a construction comprising at least one thermographic emulsion layer and any substrates, top-coat layers, image receiving layers, blocking layers, antihalation layers, subbing or priming layers, etc.

"emulsion layer" means a layer of a photothermographic element that contains the photosensitive silver halide and non-photosensitive reducible silver source material; or a layer of the thermographic element that contains the non-photosensitive reducible silver source material.

Other aspects, advantages, and benefits of the present invention are disclosed and apparent from the detailed description, examples, and claims.

BRIEF DESCRIPTION OF THE DRAWINGS

The foregoing advantages, construction, and operation of the present invention will become more readily apparent from the following description and accompanying drawings.

DETAILED DESCRIPTION OF THE INVENTION

Figure 5:
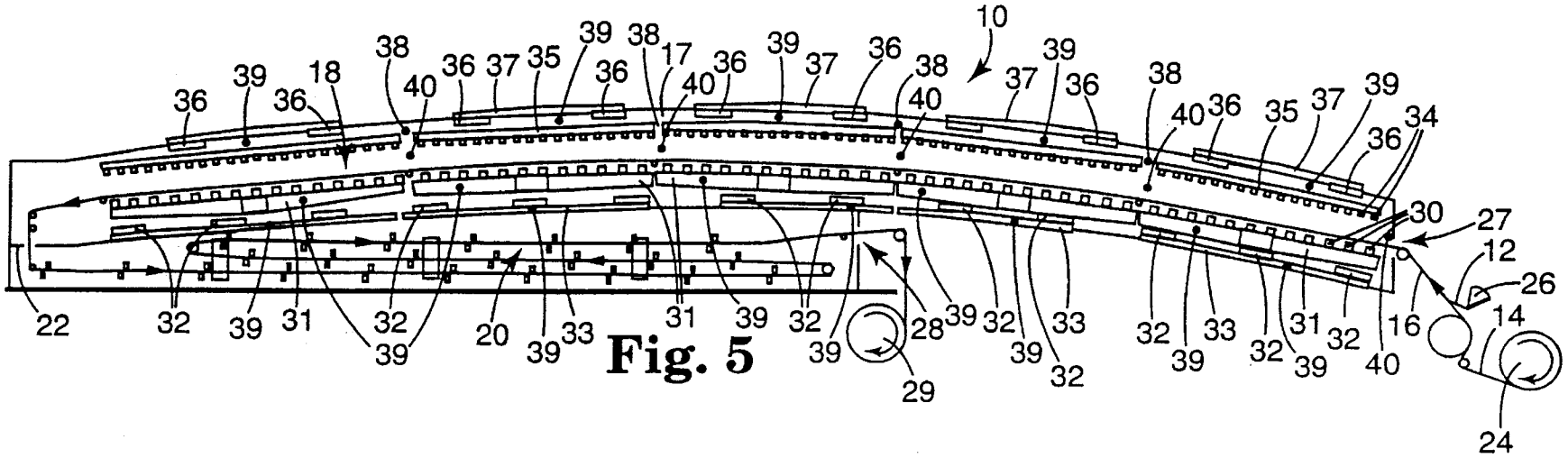
FIG. 5 is a side view of a drying apparatus in accordance with the present invention.
Figure 6:
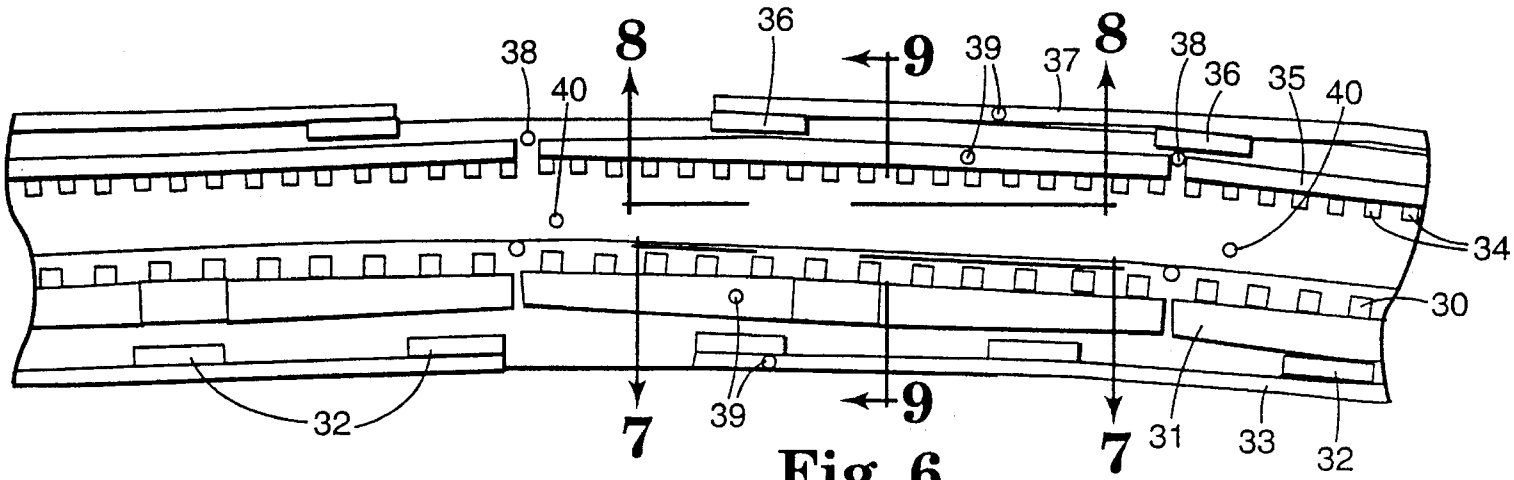
FIG. 6 is a partial side view of the drying apparatus shown in FIG. 5.

A drying apparatus 10 is illustrated generally in FIG. 5 and more specifically in FIGS. 6–10. This drying apparatus 10 is useful for drying a coating 12 which has been applied to (i.e., coated onto) a substrate 14 forming a coated substrate 16. When the coating 12 comprises a film-forming material or other solid material dissolved, dispersed, or emulsified in an evapotable liquid vehicle, drying means evaporating the evaporable liquid vehicle (e.g., solvent) so that a dried, film or solids layer (e.g., an adhesive layer or a photothermographic layer) remains on the substrate 14. Hereinafter, the more generic "evapotable liquid vehicle" will herein be referred to as a "solvent."

While suitable for a wide variety of coatings, the drying apparatus 10 is particularly suited for drying photothermographic and thermographic coatings to prepare photothermographic and thermographic articles. The drying apparatus 10 has the ability to dry such coatings in a relatively short period of time while minimizing the creation of drying-induced defects, such as mottle. The following disclosure describes embodiments of the drying apparatus 10, embodiments of methods for using the drying apparatus 10, and details pertaining to materials particularly suited for drying by the drying apparatus 10.

The Drying Apparatus 10

FIGS. 5–10 show an embodiment of the drying apparatus 10 which generally can include a drying enclosure 17 with a first zone 18 and a second zone 20. The first and second zones 18, 20 can be divided by a zone wall 22. As will become more apparent later within this disclosure, the first zone 18 is of primary importance. The first zone 18 and the second zone 20 can each provide different drying environment. In addition, the first zone 18 can provide a plurality of drying environments therein, which will be discussed further.

The substrate 14 can be unwound by a substrate unwinder 24, and the coating 12 is shown as being coated onto the substrate 14 by coating apparatus 26. The coated substrate 16 can enter the drying apparatus 10 through a coated substrate entrance 27 and be dried when traveling through the first and second zones 18, 20. The coated substrate can exit the drying apparatus 10 through a coated substrate exit 28 then be wound at the coated substrate winder 29. Although the coated substrate 16 is shown as following an arched path through the first zone 18, the path could be flat or have another shape. And, although the coated substrate 16 is shown being redirected within zone 2 such that the coated web takes three passes through zone 2, the drying apparatus 10 could be designed such that fewer or more passes occur.

The first zone 18 is more specifically shown in FIGS. 6–10 as including a number of air foils 30 which are located below the coated substrate 16 along the length of the first zone 18. The air foils 30 supply drying gas (e.g., heated air, inert gas) toward the bottom surface of the coated substrate 16 such that the coated substrate can ride on a cushion of drying gas. Drying gas is supplied to a group of air foils 30 by an air foil plenum 31.

The temperature and gas velocity of the drying gas supplied from a group of air foils 30 can be controlled by controlling the temperature and pressure of the drying gas in the corresponding air foil plenum 31. Consequently, independent control of the temperature and pressure of the drying gas within each air foil plenum 31 allows for independent control of the temperature and gas velocity of the drying gas supplied by each group of air foils 30.

Although each air foil plenum 31 is shown as supplying a group of either twelve or fifteen air foils 30, other ducting arrangements could be used. An extreme example would be for one air foil plenum 31 to supply drying gas to only one air foil 30. With this arrangement, independent control of the temperature and pressure for each air foil plenum 31 would result in independent control of the temperature and gas velocity of the drying gas exiting from each air foil 30.

Figure 10:
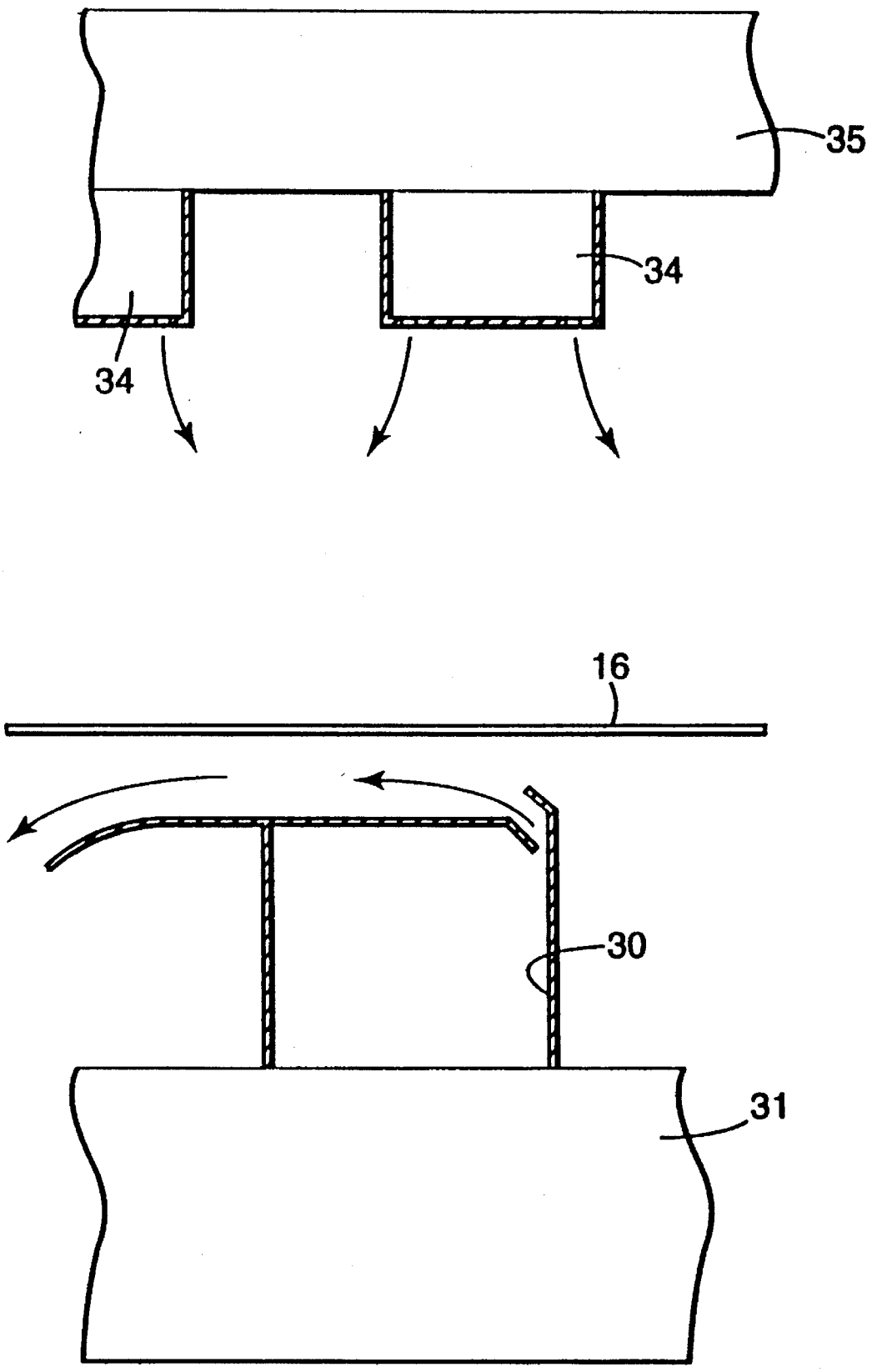
FIG. 10 is a side schematic view of an air foil and an air bar which are shown in FIGS. 5–9.

Each of the air foils can have a foil slot (the side view of which is shown in FIG. 10) through which a stream of drying gas enters into the drying apparatus 10. The foil slot can have a slot width which is not significantly wider than the substrate width such that mottle on the first and second coating edges is minimized. Setting the width in this way affects the flow of the drying gas around the edges of the substrate. When the foil slot width is approximately equal to or narrower than the width of the substrate, mottle on the edges of the liquid is reduced.

Figure 7:
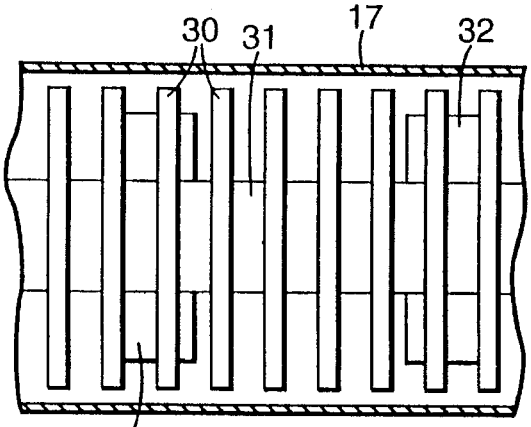
FIG. 7 is a partial sectional view of the drying apparatus shown in FIG. 6.
Figure 8:
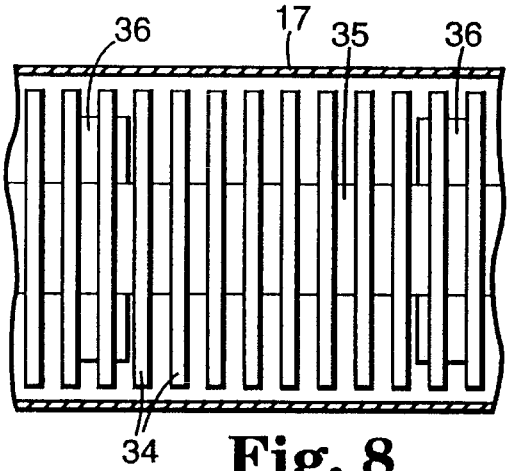
FIG. 8 is a partial sectional view of the drying apparatus shown in FIG. 6.
Figure 9:
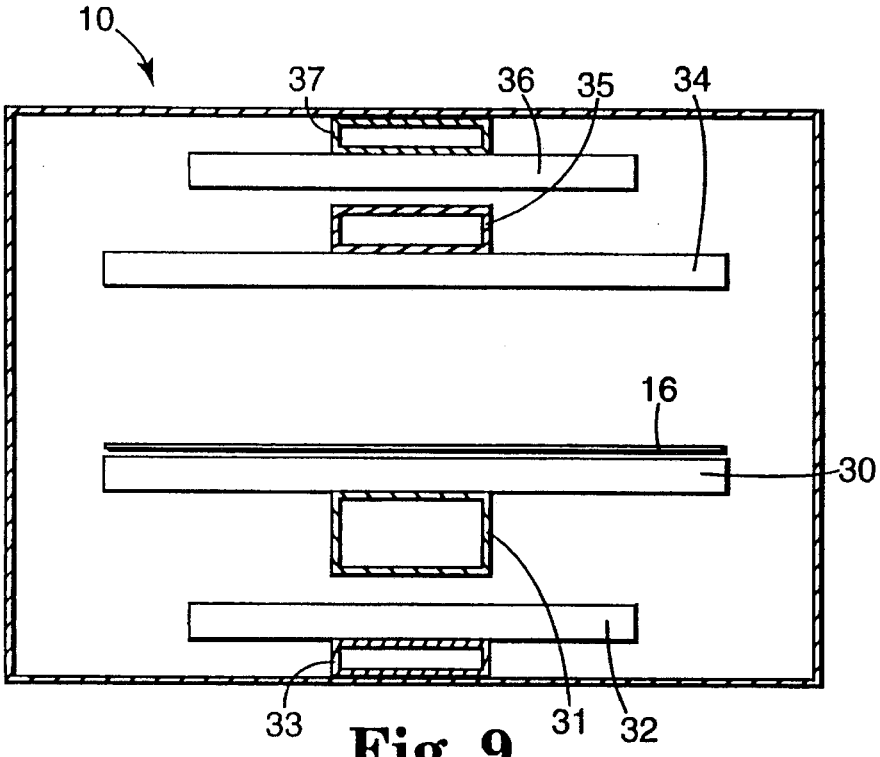
FIG. 9 is a sectional front view of the drying apparatus shown in FIG. 6.

FIG. 10 illustrates the flow of air out of a foil slot of an air foil 30 and FIG. 7 illustrates the length of air foils 30. Because the slot can be made to extend to the ends of the air foil 30, the slot length can virtually be as long as the length of the air foil 30. Because the drying apparatus 10 can be used to dry coated substrates 16 having a widths which are significantly less than the foil slot length (as well coated substrates 16 having widths approximately equal to or even wider than the foil slot length), one or both of the ends of the foil slot can be deckled such that the foil slot length is approximately equal to the width of the narrower coated substrates. The length of the slots can be deckled or adjusted by covering more or less of the ends of the slots with a material such as an adhesive tape. Alternatively, a metal plate at each edge of the foil slots could be inwardly and outwardly movable to close off more or less of the foil slot. Also, ends of the slots could be plugged with a material, such as a conformable material (e.g., rubber).

Lower exhaust ports 32 are positioned below the air foils 30 to remove the drying gas, or at least a portion of the drying gas, supplied by the air foils 30. The drying gas exhausted by a group of lower exhaust ports 32 is exhausted into a lower exhaust plenum 33. Five lower exhaust plenums 33 are shown, each of which is connected to two lower exhaust ports 32. Lower exhaust ports 32 are distributed throughout the lower interior portion of the drying apparatus 10 to remove drying gas throughout the drying apparatus 10 rather than at concentrated points. Other similar ducting arrangements are envisioned.

The velocity of the drying gas through a lower exhaust port 32 can largely be controlled by controlling the static pressure difference between the lower interior portion of the drying apparatus 10 (the interior portion below the coated substrate level) and some suitable reference point (e.g., the coating room in which the coating apparatus 26 is positioned; or, each lower exhaust plenum 33). As a result, independent control of the static pressure difference between the lower interior portion of the drying apparatus 10 and each lower exhaust plenum 33 allows for independent control of the gas velocity exhausted by the group of lower exhaust ports 32 of each lower exhaust plenums 33.

The combination of the ability to independently control the drying gas supplied by each air foil plenum 31 (temperature and gas velocity) and the ability to independently control the drying gas exhausted by each exhaust plenum 33 allows for the creation of lower subzones within the first zone 18 of the drying apparatus 10. As shown, the first zone 18 has five lower subzones due to the independent control of five air foil plenums 31 and five lower exhaust plenums 33. As a result, the five lower subzones can contain drying gas with a unique temperature and a unique gas velocity (or other heat transfer coefficient factor). In other words, the coated substrate 16 can be subjected to five different drying environments (subzones).

The flow direction of the drying gas from the air foils 30 can be controlled based on the configuration of the air foils. As shown in FIG. 10, the air foils 30 can be configured to initially supply drying gas cocurrently with the travel direction of the coated substrate and against the bottom surface of the coated substrate 16 to create a cushion of air on which the coated substrate floats. The airfoils 30 can be designed such that the drying gas flows essentially parallel to the coated substrate 16 and such that the coated substrate 16 floats approximately 0.3 to 0.7 centimeters above the upper portion of the airfoils 30. While shown as causing cocurrent gas flow to the substrate travel direction, the air foils 30 could configured to cause the drying gas to impinge on the substrate second surface, to flow generally countercurrently to the substrate travel direction, to flow generally orthogonally to the substrate travel direction, or to flow generally diagonally to the substrate travel direction.

Air bars 34 are located above the coated substrate 16 along the length of the first zone 18. The air bars 34 can be used to supply top-side gas (e.g., fresh air, inert gas) which can be useful for added drying, to carry away evaporated solvent, and/or to dilute the solvent if it is necessary to control the solvent level within the drying enclosure 17. The top-side gas is supplied to a group of air bars 34 by an air bar plenum 35. Although each air bar plenum 35 is shown as supplying a particular number of air bars 34, other ducting arrangements are envisioned. If desired, the drying apparatus 10 can be used such that no gas is supplied by the air bars 34 when top-side gas is not needed or desired (e.g., when the drying apparatus 10 is filled with inert gas).

The velocity of the top-side gas supplied from a group of air bars 34 can be controlled by controlling the static pressure difference between the upper interior portion of the drying apparatus 10 (the portion above the coated substrate level) and the corresponding air bar plenum 35. Independent control of the static pressure difference between the upper interior portion of the drying apparatus 10 and an air bar plenum 35 allows for independent control of the temperature and gas velocity of the top-side gas supplied by the corresponding group of air bars 34.

Upper exhaust ports 36 are positioned above the air bars 34 to remove at least a portion of the gas supplied by the air bars 34 and can remove at least a portion of the solvent which is evaporating from the coated substrate 16. The top-side gas exhausted by a group of upper exhaust ports 36 is exhausted into an upper exhaust plenum 37. Five upper exhaust plenums 37 are shown, each of which is connected to two upper exhaust ports 36. Upper exhaust ports 36 are distributed throughout the upper interior portion of the drying apparatus 10 to remove top-side gas throughout the drying apparatus 10 rather than at concentrated points. Other similar ducting arrangements are envisioned.

The gas velocity of the top-side gas through a group of upper exhaust ports 36 can largely be controlled by controlling the static pressure difference between the upper interior portion of the drying apparatus 10 and some suitable reference point (e.g., the coating room in which the coating apparatus 26 is position, or each upper exhaust plenum 37). Consequently, independent control of the static pressure difference between the upper interior portion of the drying apparatus 10 and each upper exhaust plenum 37 allows for independent control of the gas velocity exhausted by the group of upper exhaust ports 36 of each upper exhaust plenum 37.

FIG. 10 illustrates a side view of an air bar 34. Top-side gas is shown exiting two openings. The length of the openings for the air bar 34 can be approximately equal to or less than the length of the air bar 34. If each opening were instead a series of discrete holes rather than a single opening, the air bar 34 would be considered a perforated plate, or even a foraminous plate. A perforated or formanous plate could be used in place of the air bar 34, as could other sources of top-side gas (e.g., air turn, air foil).

The locations of pyrometers 38, static pressure gages 39, and anemometers 40 are shown in FIG. 5. These known instruments can be used to measure the temperature, static pressure, and gas velocity of the drying gas at various locations within the drying apparatus 10. The measurements taken by these instruments can be directed to a central processing unit or other controlling mechanism (not shown) which can be used to control the conditions within the oven 10 by altering the drying gas temperature and pressure within the plenums.

Figure 11:
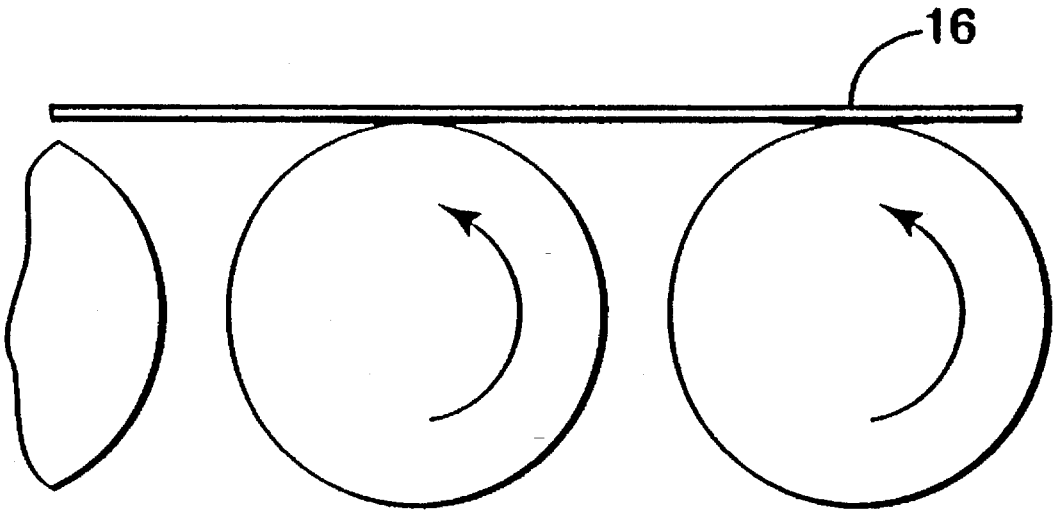
FIG. 11 is a side view of an alternative embodiment of the drying apparatus shown in FIGS. 5–10.
Figure 12:
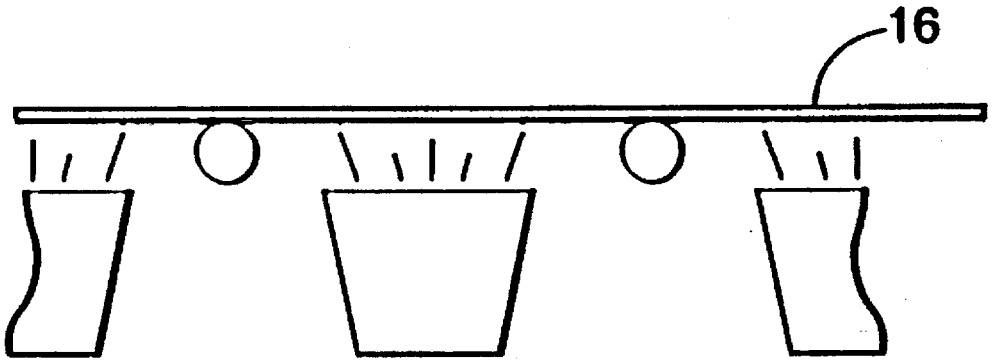
FIG. 12 is a side view of alternative embodiment of the drying apparatus shown in FIGS. 5–11.

To provide the necessary heat to the coated substrate to evaporate the coating solvent (i.e., the solvent portion of the coating), the drying gas can be air or an inert gas. Or, the use of a drying gas can be replaced or augmented with the use of heated rolls 50 on which the coated substrate can ride, as shown in FIG. 11. Similarly, infrared heat can be used in place of the drying gas such as with the spaced infrared heaters shown in FIG. 12 or with a heated plate positioned above or below the coated substrate 16. The temperature of each heated roller 50 or infrared heater 52 (or a group of rollers 50 or infrared heaters 52) can be independently controlled.

Methods For Drying Using the Drying Apparatus 10

It has been found that coatings can be dried without introducing significant mottle deflects by controlling the heat transfer rate to the coating 12 and by minimizing disturbances of the gas adjacent to the coated side of the coated substrate 16 (i.e., top-side gas; see Examples Section). When the coating solvent is evaporated using a drying gas, as for example in a drying apparatus 10, the heat transfer rate ($h\Delta T$) to the coated substrate is the product of the heat transfer coefficient of the drying gas (h) and the difference in temperature ($\Delta T$), between the temperature of the drying gas in contact with it ($T_{gas}$) and the temperature of the coated substrate ($T_{CS}$). (The temperature of the coating 12 is assumed to equivalent to the temperature of the coated substrate. The heat transfer rate to the coating 12 is the key to preventing or minimizing mottle formation.) In order to prevent mottle formation in the coating 12 during drying, this heat transfer rate ($h\Delta T$) to the coating 12 must be kept below a threshold mottle-causing value. When a particular substrate 14 is used, the heat transfer rate to the coated substrate 16 must be kept below a corresponding threshold mottle-causing value.

As a particular coating 12 is dried (or otherwise solidified), it will eventually reach a point in which it becomes virtually mottle-proof. At this point, the heat transfer rate can be significantly increased by increasing the temperature difference $\Delta T$ and/or by increasing the heat transfer coefficient h (e.g., by increasing the velocity of the drying gas on either the coated side or the non-coated side of the coated substrate 16).

For a typical drying zone, the heat transfer coefficient h and the drying gas temperature $T_{gas}$ are relatively constant and the temperature of the coated substrate 16 (and the coating 12) increases as the coated substrate 16 is heated. Therefore, the product ($h\Delta T$) has its maximum value at the initial point of the zone. Often, it is sufficient to keep the initial heat transfer rate to the coating ($h\Delta T_i$) below a maximum allowable (threshold) value in order to avoid mottle in a particular drying zone.

The most efficient process for drying a coating (i.e., evaporating a coating solvent) will be one that adds heat most quickly without causing mottle. As the coated substrate temperature $T_{CS}$ increases, the heat transfer rate ($h\Delta T$) decreases along the drying zone making the drying zone less efficient (due to the smaller $\Delta T$). The total amount of heat transferred to the coated substrate (q) can be calculated by integrating the product ($h\Delta T$) across the length of the oven and the width of the coating. When the coating width is relatively constant, the total amount of heat transferred to the coated substrate 16 is proportional to the area under the heat transfer rate curves described and shown below. Maximizing the area under the curve maximizes the heat transferred to the coated substrate and maximizes the efficiency of the drying process.

The maximum allowable or threshold heat transfer rate of a particular coating varies proportionately to the viscosity of the coating 12. A coating having less thickness or a higher viscosity would have a higher maximum allowable or threshold heat transfer rate. This also means that, as the coating 12 is further dried, the viscosity will increase and the coating thickness will decrease thereby increasing the threshold heat transfer rate. Consequently, the coating can be heated at an increasingly higher heat transfer rate as the threshold temperature curve allows. Furthermore, the coating 12, as previously noted, will eventually be dried to a point of being mottle-proof(i.e., not susceptible to mottle by the gas temperature nor by the gas velocity and any other factor affecting the heat transfer coefficient h).

In the following discussion, the heat transfer coefficient h, of the drying gas is kept constant and the drying gas temperature $T_{gas}$ is allowed to vary. When there is a maximum heat transfer rate $(h\Delta T)_{max}$ that can occur without causing mottle, there will then be a given maximum allowable difference between the temperature of the drying gas and the temperature of the coated substrate 16.

Instead of varying the gas temperature, the temperature can be held constant while varying the heat transfer coefficient h. If the velocity of the drying gas is used to vary the heat transfer coefficient, the velocity must be kept below a maximum allowable or threshold velocity to prevent mottle.

The advantage of the additional zones is described in the Examples Section and illustrated in FIGS. 13–22. Table 1 below shows typical drying gas and coated substrate temperatures for the drying conditions described below and for a particular coated substrate 16. Cooling of the web due to solvent evaporation is assumed negligible for the discussion below.

TABLE 1

Typical Drying Conditions Which Correspond With FIGS. 13–22.

| | |
|---|---|
| Heat Transfer Coefficient - h | 5 cal/sec-m$^2$-°C. |
| Initial Coated Substrate Temperature $T_{CSi}$ | 20° C. |
| Maximum Heat Transfer Rate Without Mottle Formation - $h\Delta T$ | 150 cal/sec-m$^2$ |
| Drying Length | 30 m |
| Width of Coating on Substrate | 1 m |

Figure 13:
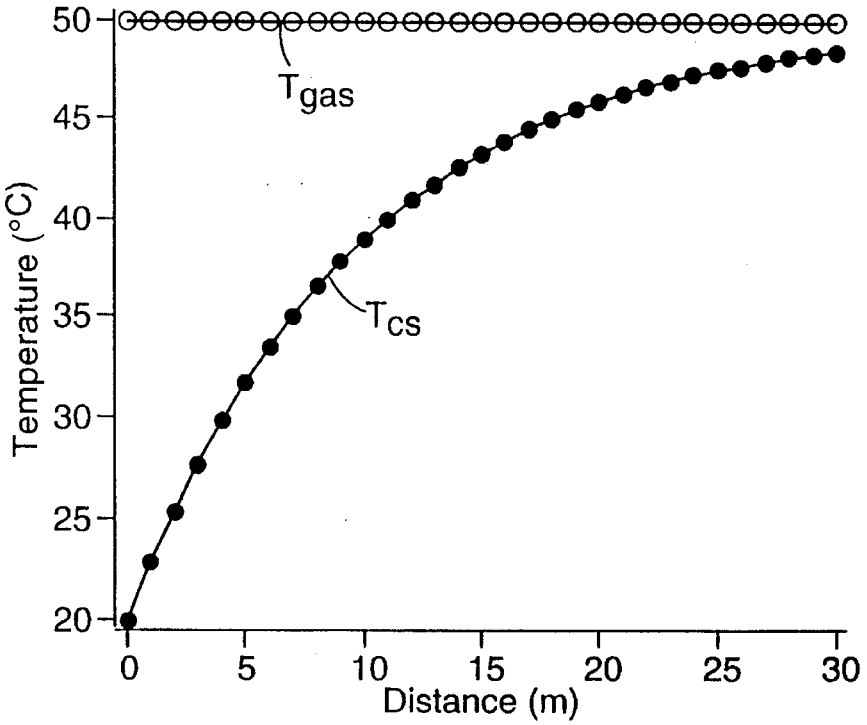
FIG. 13 is a graph illustrating the constant temperature of a drying gas within a drying oven and the resulting coating temperatures as a function of distance traveled within the oven.
Figure 14:
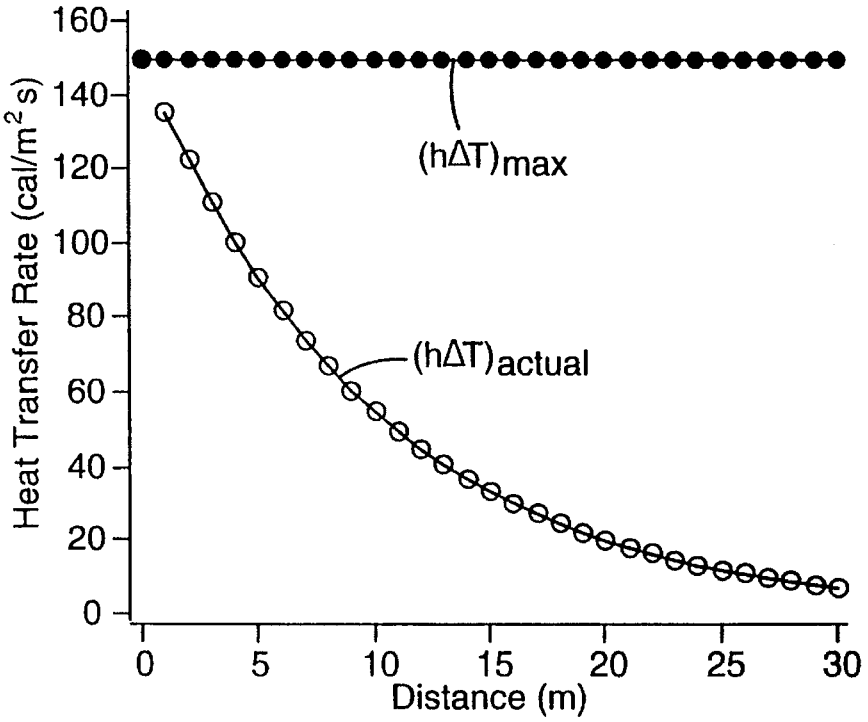
FIG. 14 is a graph illustrating the maximum allowable heat transfer rate and actual heat transfer rate to the coating as a result of the constant drying gas temperature illustrated in FIG. 13.

FIG. 13 shows typical temperature curves for the coated substrate 16. The coated substrate 16, initially at 20° C., is subjected to a constant drying gas temperature of 50° C. The temperature of the coated substrate 16 slowly increases over the length of the drying zone (30 m) until it reaches the temperature of the drying gas. FIG. 14 shows the product $h\Delta T$ at any given location as drying proceeds. At all times, the heat transfer rate is at or below the maximum allowable heat transfer rate of 150 cal/sec-m$^2$ and mottle is not caused. The amount of heat transferred to the coated substrate 16 per unit time drops off as the temperature of the coated substrate $T_{CS}$ increases. At the end of the drying zone this amount is significantly less than the maximum allowable heat transfer rate. Thus, the process is much less efficient than it could be.

Figure 15:
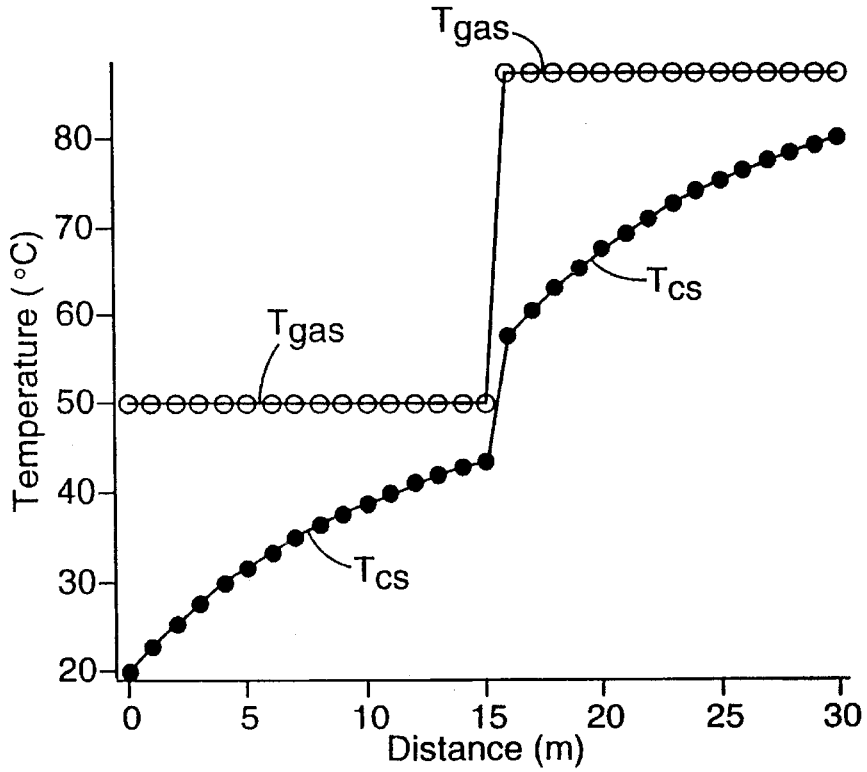
FIG. 15 is a graph illustrating the resulting coating temperatures as a function of distance traveled within an oven when the coating is subjected to two different drying gas temperatures.
Figure 16:
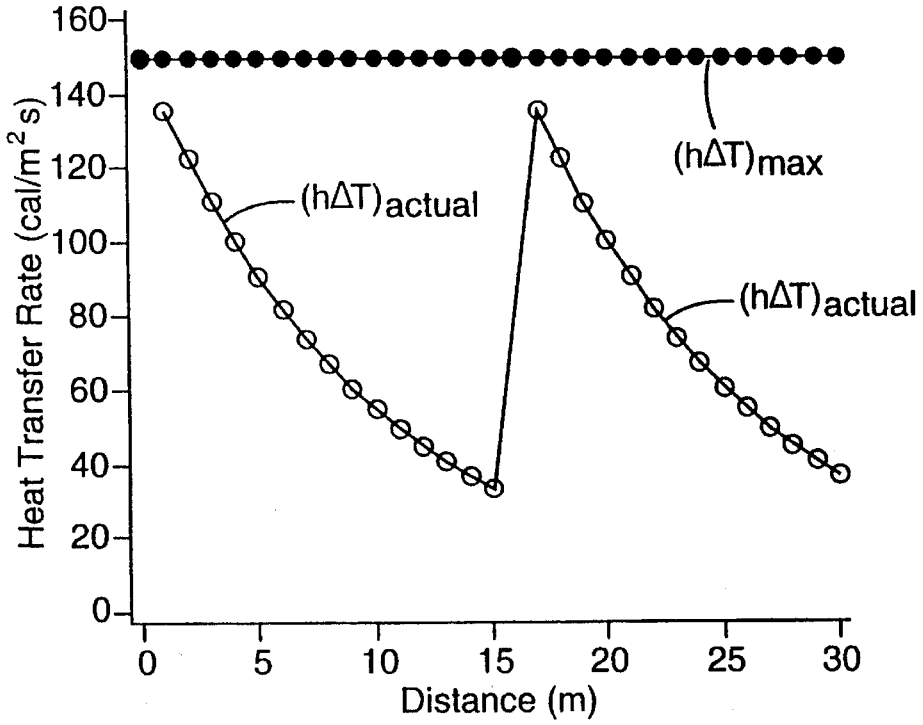
FIG. 16 is a graph illustrating the maximum allowable heat transfer rate and the actual heat transfer rate to the coating as a result of being subjected to the two drying gas temperatures illustrated in FIG. 15.

FIGS. 15 and 16, demonstrate the advantage when the drying process is divided into two equal zones. The advantage of the second zone is that the drying gas temperature, $T_{gas}$ can be increased allowing the product $h\Delta T$ to increase and drying in the second zone can take place more rapidly. Again, at all times the product $h\Delta T$ is kept below 150 cal/sec-m$^2$, the maximum allowable heat transfer rate without causing mottle. It should be noted that the total heat transferred to the coated substrate, represented by the area under the heat transfer rate curve in FIG. 16 is now considerably larger than for the case where only one zone is used.

Figure 17:
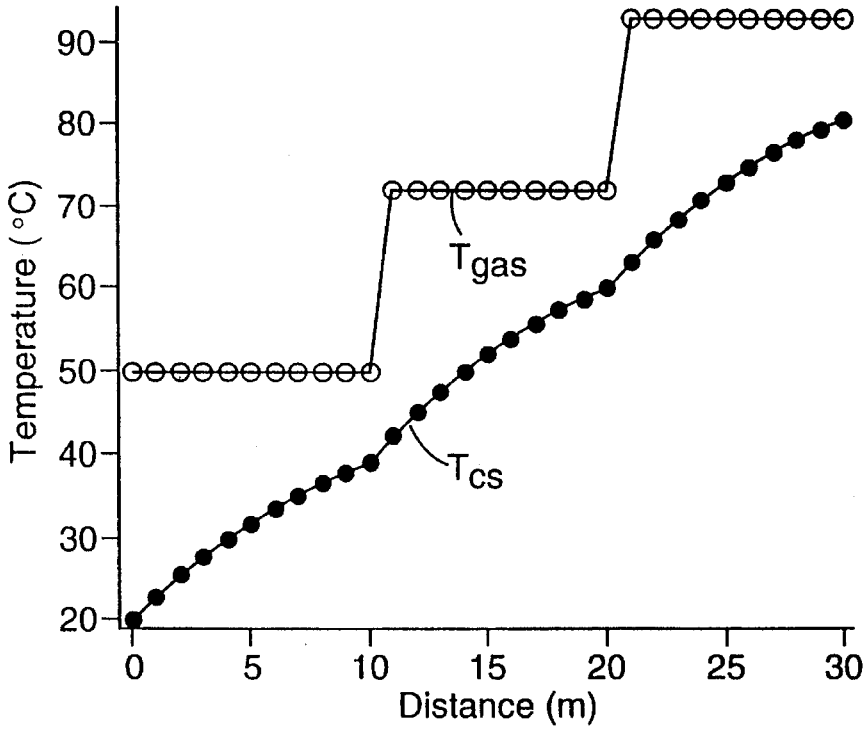
FIG. 17 is a graph illustrating the resulting coating temperatures as a function of distance traveled within an oven when the coating is subjected to three different drying gas temperatures.
Figure 18:
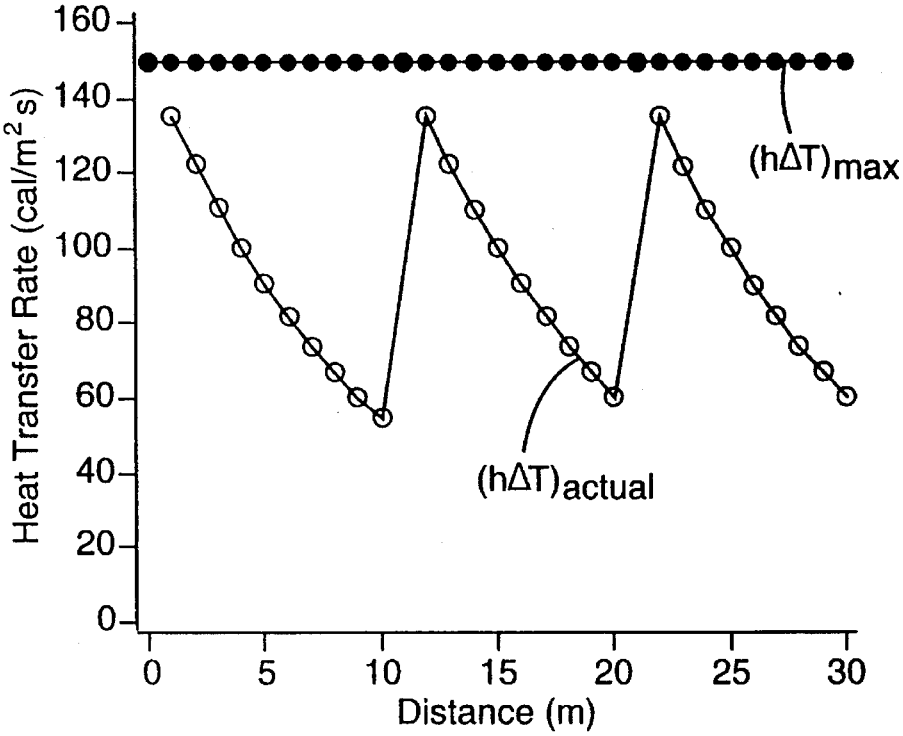
FIG. 18 is a graph illustrating the maximum allowable heat transfer rate and the actual heat transfer rate to the coating as a result of being subjected to the three drying gas temperatures illustrated in FIG. 17.
Figure 19:
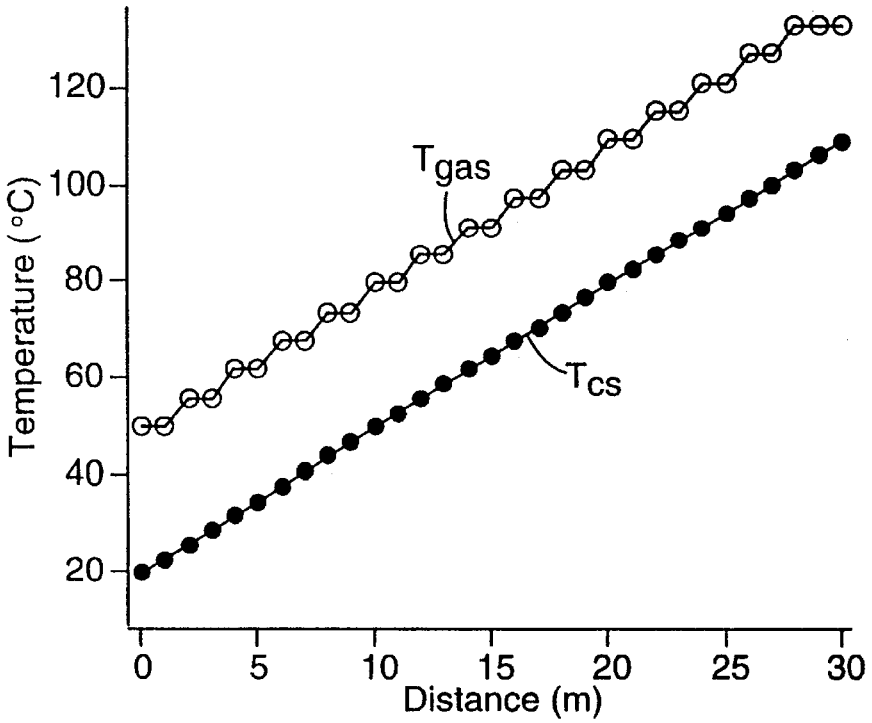
FIG. 19 is a graph illustrating the resulting coating temperatures as a function of distance within an oven when the coating is subjected to fifteen different drying gas temperatures.
Figure 20:
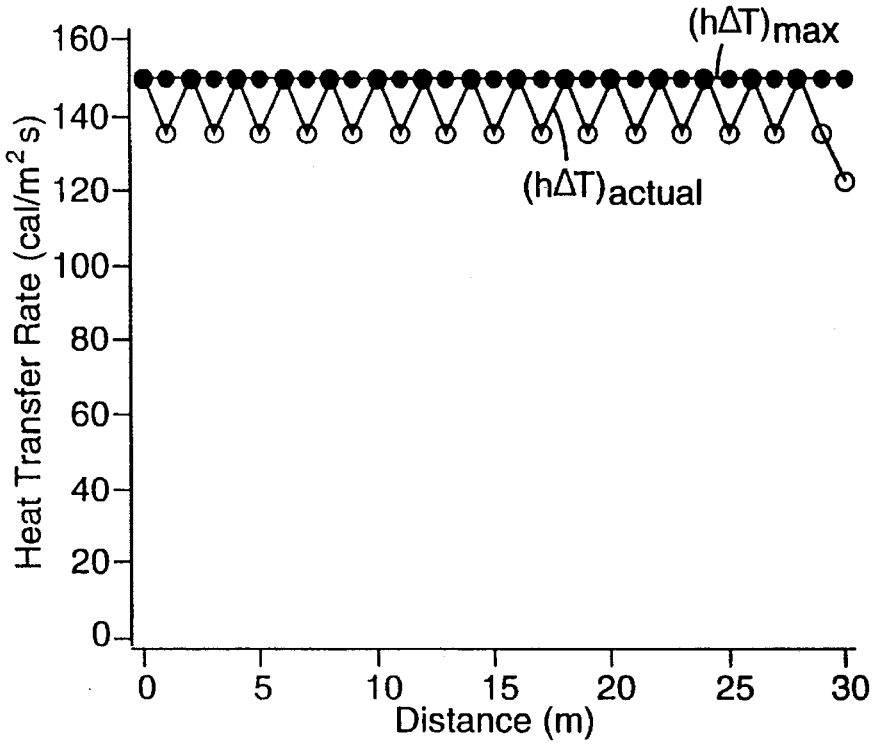
FIG. 20 is a graph illustrating the maximum allowable heat transfer rate and the actual heat transfer rate to tile coating as a result of being subjected to the fifteen drying gas temperatures illustrated in FIG. 19.

Similarly, FIGS. 17 and 18 demonstrate that the total amount of heat transferred for drying is even greater and the process more efficient when three heating environments or zones are used. When 15 heating environments or zones are used as shown in FIGS. 19 and 20, the process is even more efficient. In an extreme limit, where the drying environments or zones are infinitesimally small in size and infinite in number, the drying gas temperature can be continuously increased to maximize the allowable heat transfer rate to the coated substrate while still avoiding mottle.

Figure 21:
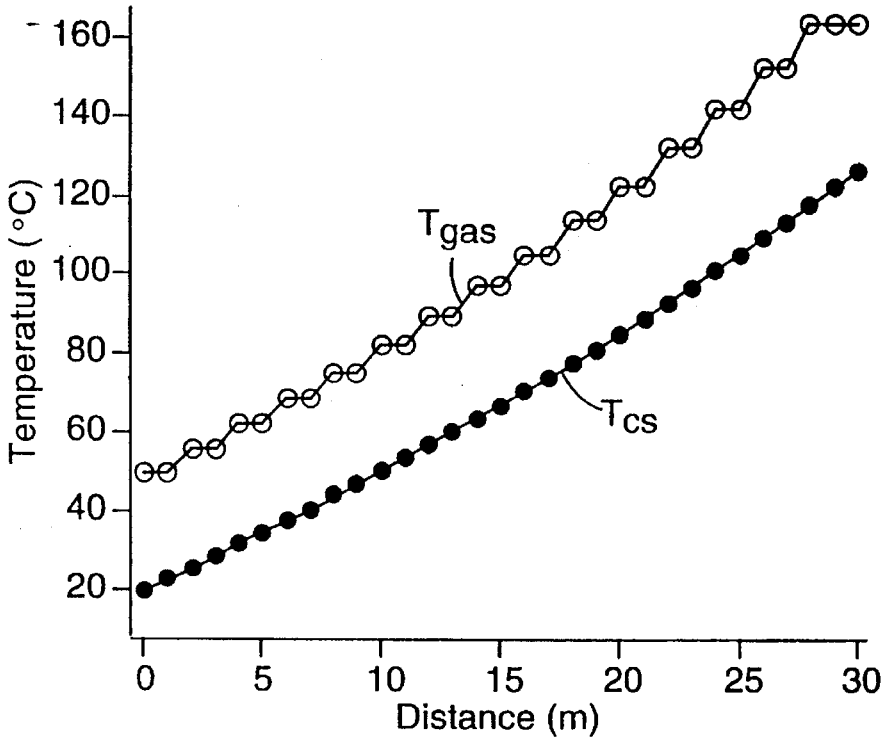
FIG. 21 is a graph illustrating the resulting coating temperatures as a function of distance within an oven when the coating is subjected to fifteen different drying gas temperatures where the maximum allowable heat transfer rate increases along the length of the oven.
Figure 22:
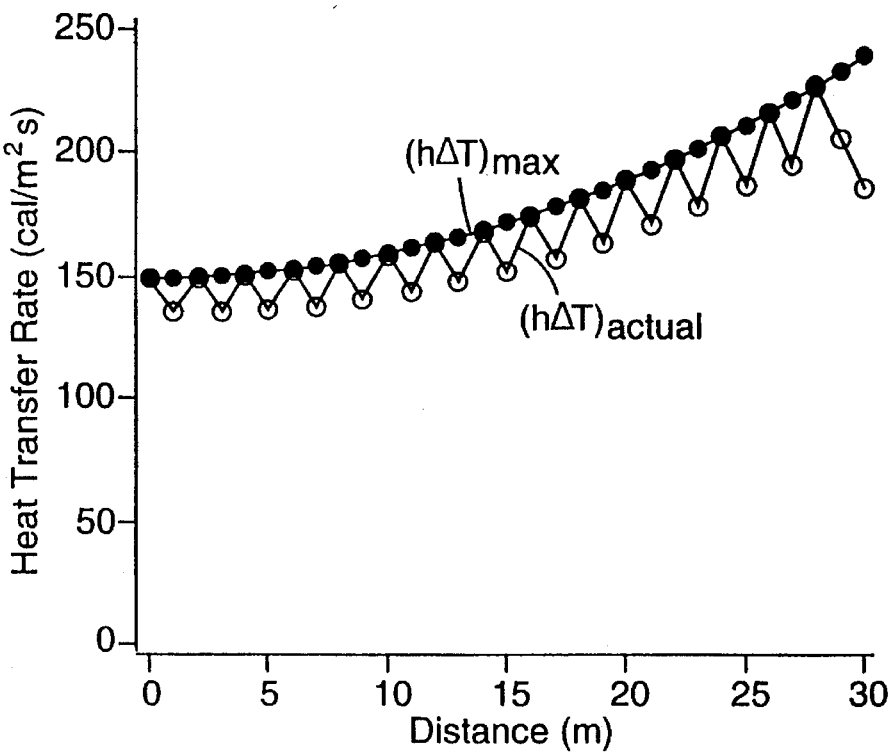
FIG. 22 is a graph illustrating tile maximum allowable heat transfer rate and the actual heat transfer rates to the coating as a result of being subjected to the fifteen drying gas temperatures illustrated in FIG. 19.

FIGS. 13–20 represent a simplified case. In reality, as the coating solvent begins to evaporate (e.g., coating begins to dry), its viscosity increases and its thickness decreases. As a result, the maximum possible heat transfer rate ($h\Delta T$) to the partially dried coating can be increased without formation of mottle. FIGS. 21–22 show that by increasing the heat transfer rate to correspond to the increasing maximum allowable heat transfer rate, the rate of drying can be increased even more rapidly than the simplified case shown in FIGS. 19–20 in which maximum allowable heat transfer rate is assumed constant.

Table 2 shows the total amount of heat (q) transferred to the coated substrate for different numbers of drying environments or zones.

TABLE 2

Drying Variables for FIGS. 13–19, and 22.

| Subzones | Total Amount of Heat Transferred (cal/sec) | Corresponding Figures |
|---|---|---|
| 1 | 1427 | 13, 14 |
| 2 | 2389 | 15, 16 |
| 3 | 2936 | 17, 18 |
| 15 | 4269 | 19, 20 |
| ∞ | 4500 | No Figure |
| 15* | 5070 | 21, 22 |

*With increasing maximum allowable heat transfer rate.

Further advantages and efficiency can be gained by using subzones of unequal size. For example, a larger number of smaller subzones will be advantageous in regions where the maximum allowed heat transfer rate is changing most quickly. It is also possible for evaporative cooling to lower the temperature of the coated substrate $T_{CS}$ within a drying subzone and the product ($h\Delta T$) would then be at a maximum at some intermediate point within the subzone.

As previously noted, one aspect of a method for drying includes controlling the temperature and the heat transfer coefficient h within locations or subzones of the drying oven 10, in particular, the first zone 18. This can be accomplished primarily by controlling the temperature and gas velocity of the drying gas delivered by the air foil plenums 31 and removed by the lower exhaust plenum 33. The rate at which a particular air foil plenum 31 supplies drying gas and the rate at which the corresponding lower exhaust plenum 33 removes the drying gas allows a user to balance the two and virtually create a subzone having a particular gas temperature and velocity. Similar control of corresponding pairs of plenums 31, 33 allow for control of the temperature and gas velocity of the drying gas within several subzones. As a result, the heat transfer rate to the coating 12 can be controlled and maximized within several subzones. Within a first subzone, for example, the velocity of the gas on the coated side and relative to the coated side should be not greater than a top-side gas velocity threshold, such as 150 ft/min (46 m/min) to protect a mottle-susceptible photothermographic coating 12 (e.g., the photothermographic coating described in Example 1 below).

It is important to further note that the first zone 18 is shown as an open body. In other words, the first zone 18 is shown as not including slotted vertical walls (or other physical structures with openings) to act as a barriers between the previously described subzones. Control of the heat transfer rate within individual subzones can be accomplished without the need for physical barriers. Although physical barriers could be used, they are not needed nor preferred due to possibly adverse air flow effects which can result (i.e., high velocity flow of drying gas through the slot in a vertical wall). In addition, physical barriers with openings between the subzones (to allow transport of the moving coated substrate) could be used. But, preferably, the openings would be sufficiently large to minimize the pressure differential between subzones such that the formation of mottle is minimized or prevented.

It is also important to note that the temperature and gas velocity of the drying gas within a particular subzone and within the first zone 18 as a whole can be controlled with the use of the previously noted pyrometers 38, static pressure gauges 39, anemometers 40, and the previously noted controlling mechanism (not shown). The pyrometers 38 can sense the temperature of the coated substrate $T_{CS}$. The static pressure gauges 39 can sense the static pressure difference between a location within the interior of the drying apparatus 10 and some reference point (such as outside the drying apparatus 10 or within a nearby plenum). The anemometers 40 can sense the velocity of the drying gas.

The measurements from the pyrometers 38, static pressure gauges 39, and the anemometers 40 can allow the controlling mechanism and/or a user to adjust the heat transfer rate (temperature of the drying gas, heat transfer coefficient) to minimize mottle formation (at or below the maximum allowable or threshold heat transfer rate). For example, the pyrometers 38 can be positioned to sense the actual temperature of the coated substrate $T_{CS}$ as the coated substrate is exiting one subzone and entering a downstream subzone. Based on that actual temperature versus a targeted temperature, the previously noted controlling mechanism can determine and set the heat transfer rate in the downstream subzone to be at or below the maximum allowable or threshold heat transfer rate. This controlling ability could be referred to as a feedforward strategy for a temperature set point.

Similarly, the controlling mechanism could compare the actual and the targeted temperatures and adjust the heat transfer rate in an upstream subzone to be at or below the maximum allowable or threshold heat transfer rate. This controlling ability could be referred to as a feedback loop or strategy. The targeted temperature, previously noted, can be experimentally determined so that the heat transfer rate to the coated substrate 16 can be monitored and adjusted accordingly.

Having both static pressure gauges 39 and anemometers 40, a user has the choice as to how to control the gas velocity and direction. These two instruments could be used individually or in a coordinated fashion to control gas velocity and direction by controlling the volume of gas being exhausted from the drying apparatus 10.

Control of the static pressure differences within the first zone 18 can be used to manage the gas flow through the first zone 18. While the gas within each subzone was previously described as being managed such that gas flow from subzone to another is minimized, controlling static pressure differences across the entire first zone 18 can provide the ability to create a controlled degree of gas flow from one subzone to another. For example, the pressure $P_1$ within an upstream upper exhaust plenum 37 could be slightly higher than the pressure $P_2$ in a downstream upper exhaust plenum 37 such that the top-side gas flows at a low velocity in the downstream direction (i.e., cocurrent flow). This could be intentionally done to create a gas velocity of the top-side gas that approximately matches the velocity of the coated substrate 16. Matching the velocities in this way can minimize disturbances on the coated side of the coated substrate 16. Alternatively, a countercurrent flow could be induced instead of the cocurrent flow, or, a combination of cocurrent and countercurrent flows could be induced.

One can control static pressure differences to manage gas flow between the upper and lower interior portions of the drying apparatus 10. For example, setting the pressure $P_{top}$ above the coated substrate 16 at a higher value than the pressure $P_{bottom}$ below the coated substrate 16 biases the exhaust of the gas to the lower interior portion. This approach may be desired to prevent the hotter drying gas below the coated substrate from flowing upwardly and contacting the coating. Alternatively, the pressures could be biased oppositely so that a portion of the drying gas below the coated substrate flows upwardly and is exhausted from the upper exhaust ports 36, or the pressures could be adjusted such that flow between the upper and lower interior portions of the drying apparatus 10 is minimized.

It is also important to note that when the temperature of the coating 12 is increased to be virtually the same as the temperature of the drying gas, the flow of the drying gas can be reduced. Similarly, when the temperature of the coating 12 is increased to a desired temperature (even if different from the drying gas temperature), again, the flow of the drying gas can be reduced. This results in more a more efficient evaporating process. In other words, less energy is required and less cost is involved.

It is also important to note that the heat transfer coefficient h has been primarily discussed as being controlled by the velocity of the drying gas. Other factors that affect the heat transfer coefficient h include the distance between the air foil 30 and the coated substrate 16, the density of the drying gas, and the angle at which the drying gas strikes or impinges upon the coated substrate 16. For embodiments of the present invention which includes heating means other than air foils and air bars (e.g., perforated plates, infrared lamps, heated rollers, heated plates, and/or air turns), additional factors affecting the heat transfer coefficient are present.

Materials Particularly Suited For Drying By Drying Apparatus 10

Any mottle-susceptible material, such as graphic arts materials and magnetic media, can be dried using the above-described drying apparatus 10 and methods. Materials particularly suited for drying by the drying apparatus 10 are photothermographic imaging constructions (e.g., silver halide-containing photographic articles which are developed with heat rather than with a processing liquid). Photothermographic constructions or articles are also known as "dry silver" compositions or emulsions and generally comprise a substrate or support (such as paper, plastics, metals, glass, and the like) having coated thereon: (a) a photosensitive compound that generates silver atoms when irradiated; (b) a relatively non-photosensitive, reducible silver source; (c) a reducing agent (i.e., a developer) for silver ion, for example for the silver ion in the non-photosensitive, reducible silver source; and (d) a binder.

Thermographic imaging constructions (i.e., heat-developable articles) which can be dried with the drying apparatus 10 are processed with heat, and without liquid development, are widely known in the imaging arts and rely on the use of heat to help produce an image. These articles generally comprise a substrate (such as paper, plastics, metals, glass, and the like) having coated thereon: (a) a thermally-sensitive, reducible silver source; (b) a reducing agent for the thermally-sensitive, reducible silver source (i.e., a developer); and (c) a binder.

Photothermographic, thermographic and photographic emulsions used in the present invention can be coated on a wide variety of substrates. The substrate (also known as a web or support) 14, can be selected from a wide range of materials depending on the imaging requirement. Substrates may be transparent, translucent or opaque. Typical substrates include polyester film (e.g., polyethylene terephthalate or polyethylene naphthalate), cellulose acetate film, cellulose ester film, polyvinyl acetal film, polyolefinic film (e.g., polethylene or polypropylene or blends thereof), polycarbonate film and related or resinous materials, as well as aluminum, glass, paper, and the like.

EXAMPLES

The following examples provide exemplary procedures for preparing and drying articles of the invention. Photothermographic imaging elements are shown. All materials used in the following examples are readily available from standard commercial sources, such as Aldrich Chemical Co., Milwaukee, Wis., unless otherwise specified. All percentages are by weight unless otherwise indicated. The following additional terms and materials were used.

Acryloid™ A-21 is an acrylic copolymer available from Rohm and Haas, Philadelphia, Pa.

Butvar™ B-79 is a polyvinyl butyral resin available from Monsanto Company, St. Louis, Mo.

CAB 171-15S is a cellulose acetate butyrate resin available from Eastman Kodak Co.

CBBA is 2-(4-chlorobenzoyl)benzoic acid.

1,1-bis(2-hydroxy-3,5-dimethylphenyl)-3,5,5-trimethylhexane [CAS RN=7292-14-0] is available from St-Jean Photo Chemicals, Inc., Quebec. It is a reducing agent (i.e., a hindered phenol developer) for the non-photosensitive reducible source of silver. It is also known as Nonox™ and Permanax™ WSO.

THDI is a cyclic trimer of hexamethylenediisocyanate. It is available from Bayer Corporation Co., Pittsburgh, Pa. It is also known as Desmodur™ N-3300.

Sensitizing Dye-1 is described in U.S. Pat. No. 5,393,654 which is hereby incorporated by reference. It has the structure shown below.

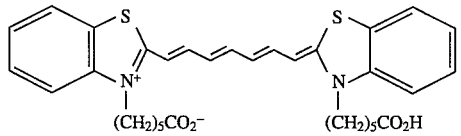

2-(Tribromomethylsulfonyl)quinoline is disclosed in U.S. Pat. No. 5,460,938 which is hereby incorporated by reference. It has the structure shown below.

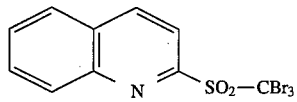

The preparation of Fluorinated Terpolymer A (FT-A) is described in U.S. Pat. No. 5,380,644, which is hereby incorporated by reference. It has the following random polymer structure, where m=70, n=20 and p=10 (by weight % of monomer).

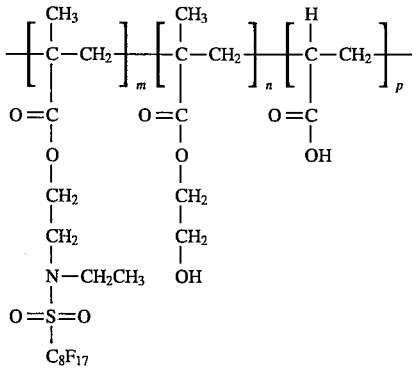

Example 1

A dispersion of silver behenate pre-formed core/shell soap was prepared as described in U.S. Pat. No. 5,382,504 which is hereby incorporated by reference. Silver behenate, Butvar™ B-79 polyvinyl butyral and 2-butanone were combined in the ratios shown below in Table 3.

TABLE 3

| Silver behenate dispersion | |
|---|---|
| Component | Weight Percent |
| Silver behenate | 20.8% |
| Butvar ™ B-79 | 2.2% |
| 2-Butanone | 77.0% |

Then, a photothermographic emulsion was prepared by adding 9.42 lb. (4.27 Kg) of 2-butanone and a premix of 31.30 g of pyridinium hydrobromide perbromide dissolved in 177.38 g of methanol to 95.18 lb. (43.17 Kg) of the preformed silver soap dispersion. After 60 minutes of mixing, 318.49 g of a 15.0 wt % premix of calcium bromide in methanol was added and mixed for 30 minutes. Then, a premix of 29.66 g of 2-mercapto-5-methylbenzimidazole, 329.31 g of 2-(4-chlorobenzoyl)benzoic acid, 6.12 g of Sensitizing Dye-1, and 4.76 lb. (2.16 Kg) of methanol was added. After mixing for 60 minutes, 22.63 lb. (10.26 Kg) of Butvar™ B-79 polyvinyl butyral resin was added and allowed to mix for 30 minutes. After the resin had dissolved, a premix of 255.08 g of 2-(tribromomethylsulfonyl)quinoline in 6.47 lb. (2.93 Kg) of 2-butanone was added and allowed to mix for 15 minutes. Then 5.41 lb. (2.45 Kg) of 1,1-bis(2-hydroxy-3,5-dimethylphenyl)-3,5,5-trimethylhexane was added and mixed for another 15 minutes. Then a premix of 144.85 g of THDI and 72.46 g of 2-butanone was added and mixed for 15 minutes. Next, 311.61 g of a 26.0% solution of tetrachlorophthalic acid in 2-butanone was added and mixed for 15 minutes. Finally, a solution of 243.03 g of phthalazine and 861.64 g of 2-butanone was added and mixed for 15 minutes.

A top-coat solution was prepared by adding 564.59 g of phthalic acid to 30.00 lb. (13.61 Kg) of methanol and mixing until the solids dissolved. After adding 174.88 lb. (79.3 Kg) of 2-butanone, 149.69 g of tetrachlorophthalic acid was added and mixed for 15 minutes. Then, 34.38 lb. (15.59 Kg) of CAB 171-15S resin was added and mixed for 1 hour. After the resin had dissolved, 2.50 lb. (1.13 Kg) of a 15.0 wt-% solution of FT-A in 2-butanone was added and mixed for 10 minutes. Then a premix of 26.33 lb. (11.94 Kg) of 2-butanone and 630.72 g of Acryloid A-21 resin and a premix of 26.33 lb. (11.94 Kg) of 2-butanone, 796.60 g of CAB 171-15S resin, and 398.44 g of calcium carbonate were added and mixed for 10 minutes.

Figure 23:
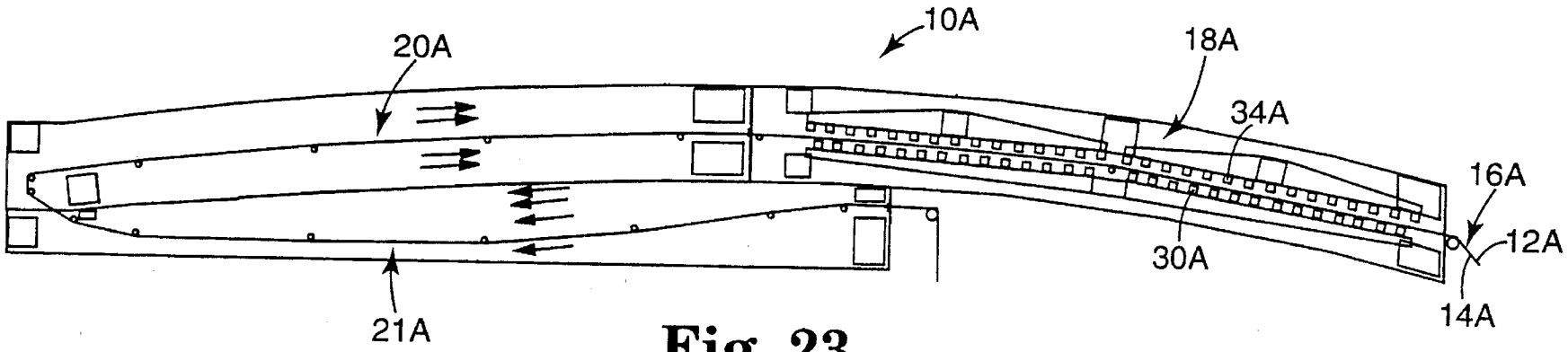
FIG. 23 is a side view of another embodiment of the drying apparatus shown generally in FIG. 5.

A drying apparatus 10A like that shown in FIG. 23 herein was used to prepare a photothermographic article. (The first zone 18A within the drying apparatus 10A shown in FIG. 23 does not have the ability to create subzones.) A polyester substrate having a thickness of 6.8 mil (173 μm) was simultaneously coated with the photothermographic emulsion and top-coat solutions at 75 ft/min (0.38 meters per second). The photothermographic emulsion layer was applied at a wet thickness of 3.2 mil (81.3 μm). The top-coat solution was applied at a wet thickness of 0.75 mil (19.1 μm). After passing the coating die, the coated substrate 16A traveled a distance of about 13 feet (4 meters) and passed through an entrance slot into a dryer composed of 3 zones. The first zone 18A was comprised of air foils 30A below the coated substrate 16A which provided drying gas and also provide flotation for the coated substrate 16A. There were also pretreated plate-type air bars 34A positioned 20 centimeters above the coated substrate 16A which provided top-side gas to maintain safe operating conditions below the lower flammability limit of the solvent. The majority of the drying heat is provided by the backside airfoils 30A (i.e., heat provided from below the substrate 14A to the coating 12A). The air temperature was set to the same value in each zone, however, the air pressure, hence the air velocity, was independently controlled for the air foils 30A and air bars 34A. The coating 12A was dried to be mottle proof within the first oven zone. The second and third oven zones 20A, 21A used counter-current parallel air flow and served to remove the residual solvent. (In the figures, air flow direction is shown with the included arrows.)

The variables investigated were the temperature of the drying gas $T_{gas}$ and heat transfer coefficient h. The heat transfer coefficient h was varied by adjusting the air foil pressure drop and was measured independently. The presence and severity of mottle was determined by preparing "greyouts." Greyouts are samples that have been uniformly exposed to light and developed at 225° F. (124° C.) using a heated roll processor (not shown) so that they have a uniform Optical Density, for example between 1.0 and 2.0.

The amount of mottle was subjectively determined by comparing samples placed on a light box. The developed films were visually inspected for mottle and rated relative to one another. Mottle was rated as high, medium, or low.

The conditions used in the first zone 18A and results obtained are summarized below in Table 4. As $\Delta P_{bot}$ or $T_{gas}$ was increased, the level of mottle was increased.

TABLE 4

| First Zone Conditions | | | | | |
|---|---|---|---|---|---|
| Example | $\Delta P_{bot}$ (kPa) | $\Delta P_{top}$ (kPa) | $T_{gas}$ (°C.) | $\Delta P_{static}$ (Pa) | Mottle Rating |
| 1-1 | 0.125 | 0.025 | 37.8 | −0.5 | Low |
| 1-2 | 0.500 | 0.025 | 37.8 | −0.5 | Medium |
| 1-3 | 0.125 | 0.025 | 60.0 | −0.5 | High |

$\Delta P_{bot}$ is the pressure drop across the airfoils 31A.
$\Delta P_{top}$ is the pressure drop across the air bars 34A.
$T_{gas}$ is the temperature of the heated drying gas.
$\Delta P_{static}$ is the pressure drop between the first zone 18A and the coater room (not shown).
The negative sign indicates that the drying apparatus 10A is at lower pressure than the coater room.
This value was maintained by modulating the exhaust fan (not shown).

Drying more harshly increased the severity of the mottle. If one were to consider increasing the drying conditions only in terms of the available operating parameters, one would not make the appropriate conclusions concerning the affects on mottle. Changing the pressure drop from 0.125 to 0.5 kPa is a factor of 4 increase. An appropriate temperature measure is the difference between the drying gas and the substrate as it enters the zone. This temperature measure increases a factor of 2.3 as the gas temperature increased from 37.8° to 60° C. One would expect that changing the air foil pressure drop would have the larger effect on mottle, however, the opposite is true.

In order to determine the effect on mottle, one needs to consider a more appropriate measure such as the product of the heat transfer coefficient and the difference between the temperature of the drying gas $T_{gas}$ and the temperature of the coated substrate $T_{CS}$ as it enters the zone. This product is the rate of heat transferred to the film and is a direct measure of the rate of heating of the film. As shown below in Table 5, increasing the initial rate of heat transfer to the film, ($h\,\Delta T_i$), increased the severity of mottle.

TABLE 5

| Example | $\Delta P_{bot}$ (kPa) | $T_{gas}$ (°C.) | $T_{CS(i)}$ (°C.) | h (cal/m$^2$ s K) | $h\Delta T_i$ (cal/m$^2$ s) | Mottle Rating |
|---|---|---|---|---|---|---|
| 1-1 | 0.125 | 37.8 | 21.1 | 13.7 | 229 | Low |
| 1-2 | 0.500 | 37.8 | 21.1 | 19.4 | 324 | Medium |
| 1-3 | 0.125 | 60.0 | 21.1 | 13.7 | 532 | High |

The term $\Delta T_i$ indicates the difference between $T_{gas}$ and $T_{CS(i)}$.
The term $T_{CS(i)}$ is the initial temperature of the coated substrate just before it enters the drying apparatus 10A.

Example 2

Using the coating materials and oven described in Example 1, the photothermographic emulsion and top-coat solution were simultaneously coated at 3.6 mil (91.4 μm) and 0.67 mil (17.0 μm) respectively on 6.8 mil (173 μm) polyester substrate. Greyouts were prepared and rated as described in Example 1. The drying conditions used and results obtained, which are shown below in Table 6, demonstrate that as the initial heat transfer rate to the film ($h\Delta T_i$) was increased, the severity of mottle increased. More specifically, at a constant heat transfer coefficient, as the initial temperature difference between the coating 12A and the drying gas was increased the severity of mottle increased.

TABLE 6

| Example | $T_{gas}$ (°C.) | $T_{CS(i)}$ (°C.) | h (cal/m$^2$ s K) | $h\Delta T_i$ (cal/m$^2$ s) | Mottle Rating |
|---|---|---|---|---|---|
| 2-1 | 37.8 | 21.1 | 13.7 | 229 | Low |
| 2-2 | 51.7 | 21.1 | 13.7 | 419 | Medium |
| 2-3 | 82.2 | 21.1 | 13.7 | 837 | High |

Example 3

Figure 1:
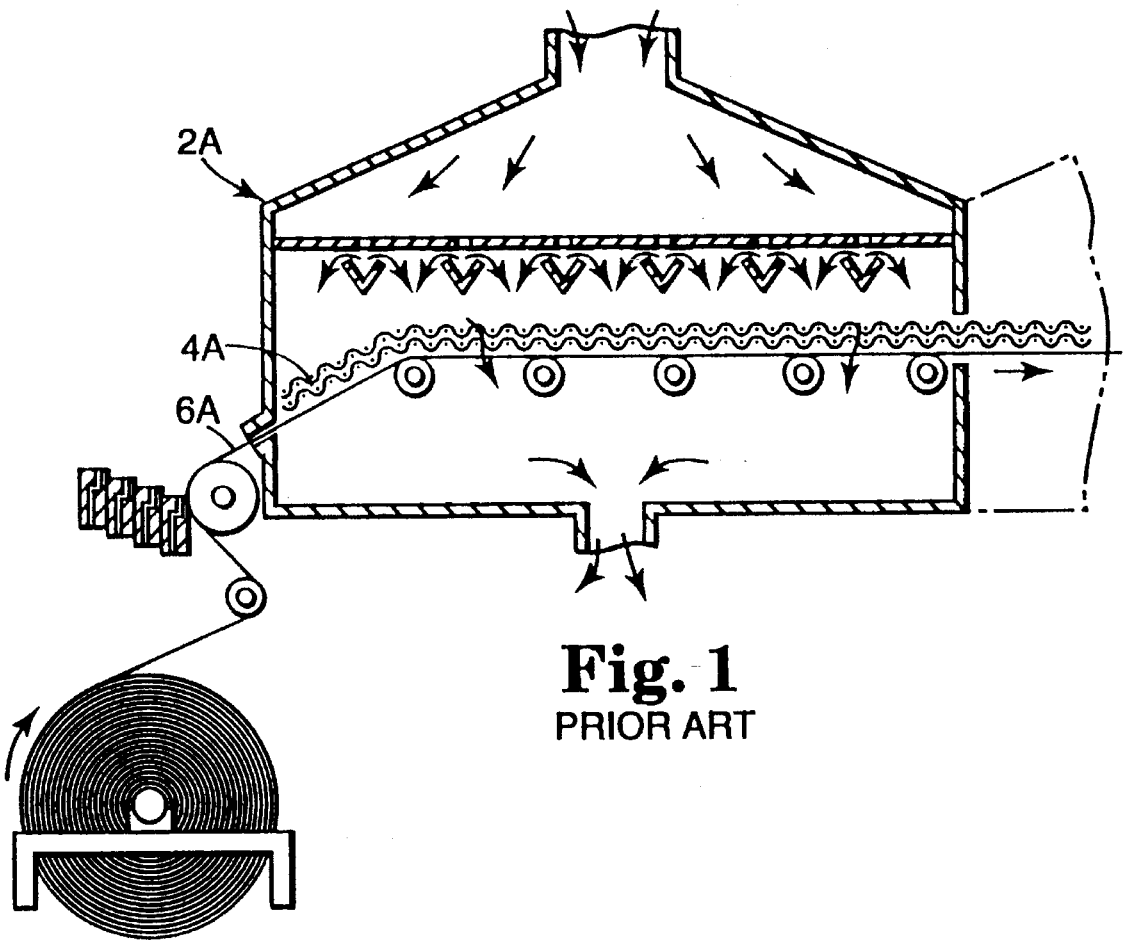
Fig. 1 PRIOR ART
FIG. 1 is a side view of a known drying apparatus.
Figure 2:
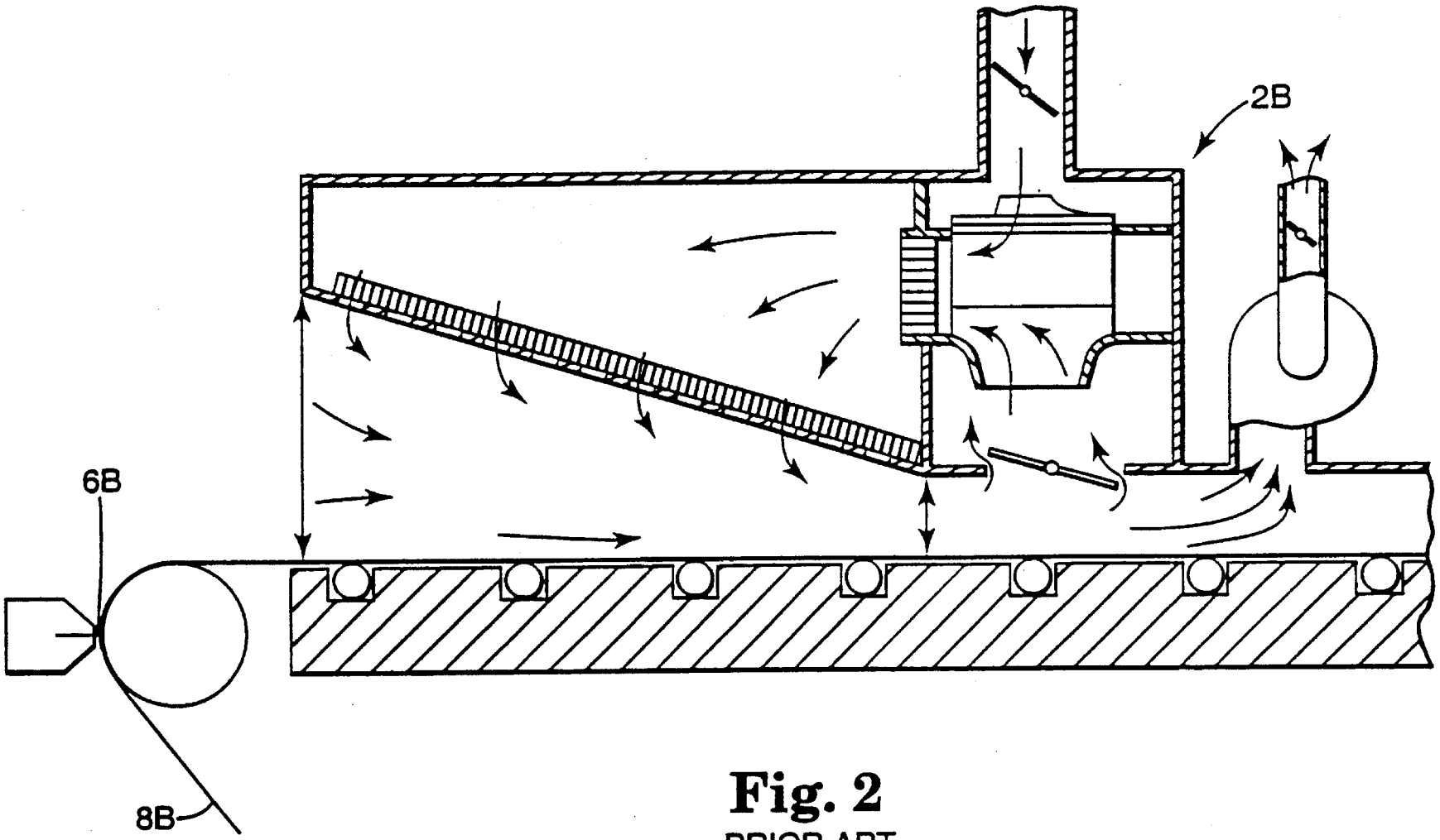
Fig. 2 PRIOR ART
FIG. 2 is a side view of another known drying apparatus.
Figure 3:
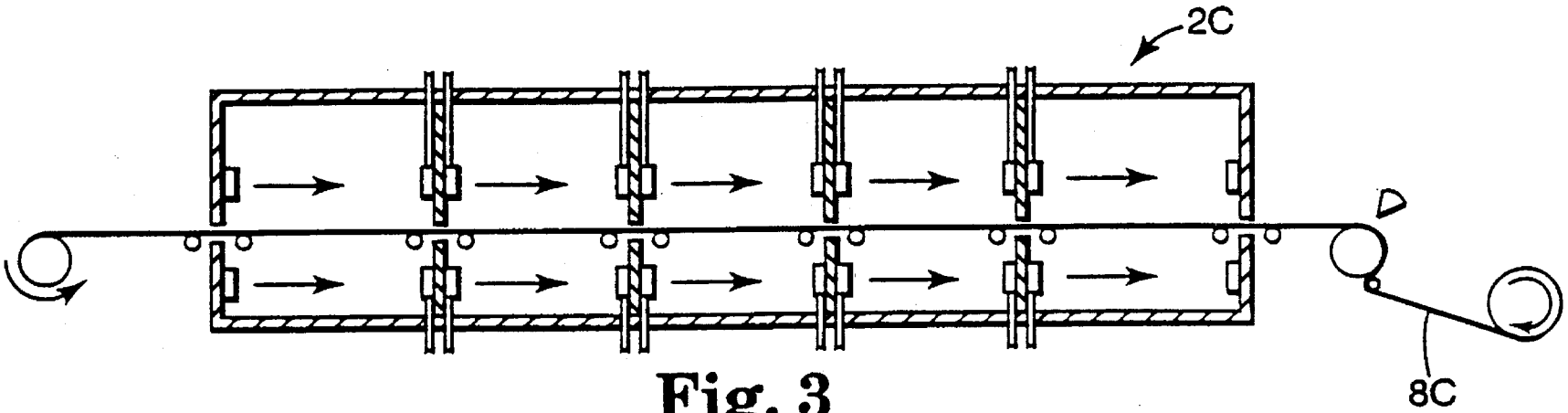
Fig. 3 PRIOR ART
FIG. 3 is a side schematic view of another known drying apparatus.
Figure 4:
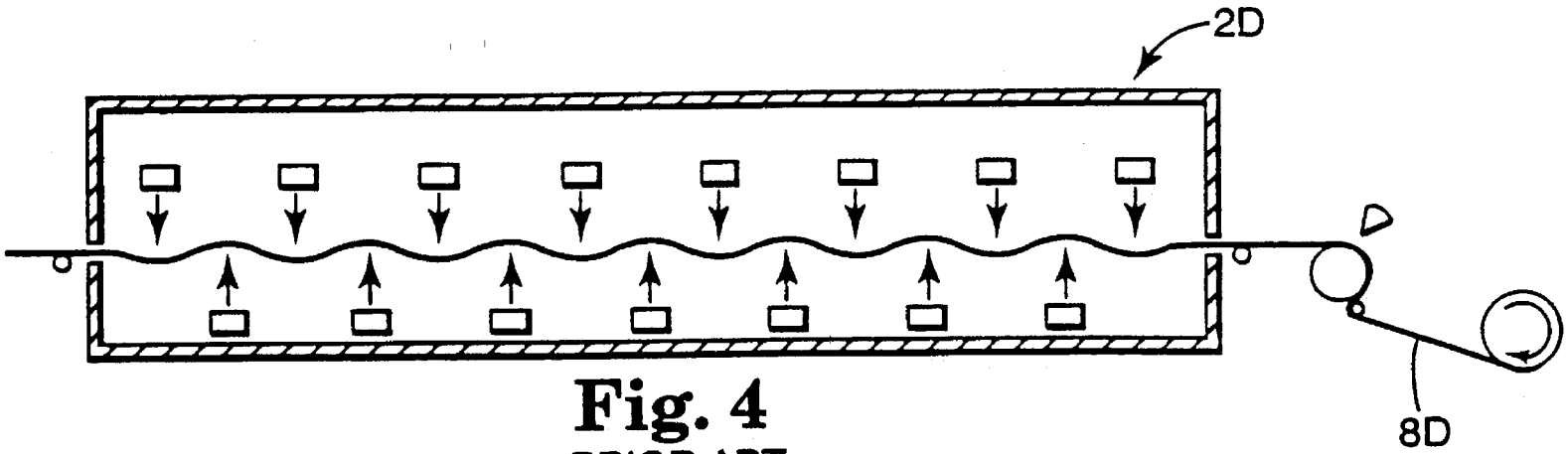
Fig. 4 PRIOR ART
FIG. 4 is a side schematic view of another known drying apparatus.

Solutions were prepared as described in Example 1 and were simultaneously coated on a polyester substrate at 100 ft/min (0.508 meters per second). After passing the coating die, the substrate traveled a distance of approximately 10 feet (3 meters) and then passed through a slot into a dryer with 3 zones similar to FIG. 3. The gas velocity of the counter-current parallel flow air was held constant and the temperature was varied as shown below in Table 7. As the initial rate of heat transfer ($h\Delta T_i$) to the coated substrate 16 was increased, the severity of mottle increased. Without considering the value of the heat transfer coefficient h, no direct comparisons between the ovens in Examples 2 and 3 is possible.

TABLE 7

| Example | $T_{gas}$ (°C.) | $T_{CS(i)}$ (°C.) | h (cal/m$^2$ s K) | $h\Delta T_i$ cal/m$^2$ s) | Mottle Rating |
|---|---|---|---|---|---|
| 3-1 | 93.3 | 21.1 | 2.85 | 206 | Low |
| 3-2 | 71.1 | 21.1 | 2.58 | 129 | Very Low |

Example 4

Solutions were prepared as described in Example 1 and were simultaneously coated on a polyester substrate at 25 ft/min (0.127 meters per second). After passing the coating die, the substrate traveled a distance of 10 ft (3 meters) and then passed through a slot into a dryer with 3 zones similar the first zone 18A of FIG. 23. This is an oven with air foils on the bottom, air bars on the top, and an overall flow of air through the oven. The atmosphere is inert gas and the partial pressure of solvent could be controlled using a condenser loop. The experimental conditions are shown below in Tables 8 (Zone 1) and 9 (Zone 2). As the product ($h\Delta T_i$) was increased in the Zone 1, the severity of mottle was increased. Also, for a given product ($h\Delta T_i$) in Zone 1, the product ($h\Delta T_i$) in Zone 2 affected mottle. When the coating was not yet mottle-proof and was entering Zone 2, decreasing the product ($h\Delta T_i$) in Zone 2 caused a reduction in the severity of mottle.

TABLE 8

| Zone 1 | | | | |
|---|---|---|---|---|
| Example | $T_{gas}$ (°C.) | $T_{CS(i)}$ (°C.) | h (cal/m$^2$ s K) | $h\Delta T_i$ (cal/m$^2$ s) |
| 4-1 | 82.2 | 21.1 | 29.0 | 1770 |
| 4-2 | 37.8 | 21.1 | 18.9 | 316 |
| 4-3 | 37.8 | 21.1 | 18.9 | 316 |

TABLE 9

| Zone 2 | | | | | |
|---|---|---|---|---|---|
| Example | $T_{gas}$ (°C.) | $T_{CS(i)}$ (°C.) | h (cal/m$^2$ s K) | $h\Delta T_i$ (cal/m$^2$ s) | Mottle Rating |
| 4-1 | 82.2 | 71.1 | 29.7 | 329 | High |
| 4-2 | 60 | 26.7 | 24.0 | 799 | Medium |
| 4-3 | 60 | 37.8 | 24.2 | 537 | Low |

Reasonable modifications and variations are possible from the foregoing disclosure without departing from either the spirit or scope of the present invention as defined by the claims.

We claim:

1. A method for evaporating a coating solvent from a coating on a first substrate surface of a first substrate and minimizing the formation of mottle as the coating solvent is evaporating, the first substrate also having a second substrate surface and a first substrate width, the coating having a first coating edge and an opposite second coating edge on the first substrate, the method comprising the steps of:

providing a drying path for the first substrate within a drying oven, the drying oven having a plurality of air foils positioned adjacent to the second substrate surface, each of the plurality of air foils having a foil slot through which a stream of drying gas is supplied to the drying oven, the foil slot having a slot length and a first slot end;

adjusting the foil slot length to not be significantly greater than the first substrate width to minimize air flow over the first and second coating edges which minimizes the creation of mottle;

applying the coating onto the first substrate surface of the first substrate to form a first coated substrate, the first substrate having the first substrate width and having a first substrate end; and transporting the first coated substrate through the drying path.

2. The method of claim 1, the first substrate having a first substrate edge, the adjusting step comprising adjusting the foil slot such that the first slot end is not more than 6.5 centimeters beyond the first substrate edge.

3. The method of claim 1, the first substrate having a first substrate edge, the adjusting step comprising adjusting the foil slot such that the first slot end is not more than 4.0 centimeters beyond the first substrate edge.

4. The method of claim 1, the first substrate having a first substrate edge, the adjusting step comprising adjusting the foil slot such that the first slot end is not more than 2.5 centimeters beyond the first substrate edge.

5. The method of claim 1, the first substrate having a first substrate edge, the adjusting step comprising adjusting the foil slot such that the first slot end is not beyond the first substrate edge.

6. The method of claim 1, the substrate width being wider than the slot length.

7. The method of claim 1, further comprising the steps of:

readjusting the foil slot length to correspond to a second substrate having a second substrate width, the second substrate width being different from the first substrate width;

applying the coating onto the second substrate to form a second coated substrate, the second substrate having the second substrate width; and transporting the second coated substrate through the drying path.

8. A method for evaporating a coating solvent from a coating on a first substrate surface of a first substrate and minimizing the formation of mottle as the coating solvent is evaporating, the first substrate also having a second substrate surface and a first substrate width, the coating having a first coating edge and an opposite second coating edge on the first substrate, the method comprising the steps of:

providing a drying path for the first substrate within a drying oven, the drying oven having a plurality of sources of drying gas impinging on the second substrate surface, the plurality of sources being positioned adjacent to the second substrate surface, each of the plurality of drying gas sources having a source length;

adjusting the source length to not be significantly greater than the substrate width to minimize gas flow over the first and second coating edges which minimizes the creation of mottle;

applying the coating onto the first substrate surface of the first substrate to form a coated substrate; and transporting the coated substrate through the drying path.

9. The method of claim 8, the plurality of sources of gas comprising at least one of an air foil, air bar, perforated plate, and air turn.

10. An apparatus for evaporating a coating solvent from a coating on a first substrate surface of a first substrate and minimizing the formation of mottle as the coating solvent is evaporating, the first substrate also having a second substrate surface and a first substrate width, the coating having a first coating edge and an opposite second coating edge on the first substrate, the apparatus comprising:

means for providing a drying path for the first substrate within a drying oven, the drying oven having a plurality of air foils positioned adjacent to the second substrate surface, each of the plurality of air foils having a foil slot through which a stream of drying gas is supplied to the drying oven, the foil slot having a slot length and a first slot end;

means for adjusting the foil slot length to not be significantly greater than the first substrate width to minimize air flow over the first and second coating edges which minimizes the creation of mottle;

means for applying the coating onto the first substrate surface to form a coated substrate, and means for transporting the coated substrate through the drying path.

11. The apparatus of claim 10, the first substrate having a first substrate edge, the adjusting means comprising means for adjusting the foil slot such that the first slot end is not more than 6.5 centimeters beyond the first substrate edge.

12. The apparatus of claim 10, the first substrate having a first substrate edge, the adjusting means comprising means for adjusting the foil slot such that the first slot end is not more than 4.0 centimeters beyond the first substrate edge.

13. The apparatus of claim 10, the first substrate having a first substrate edge, the adjusting means comprising means for adjusting the foil slot such that the first slot end is not more than 2.5 centimeters beyond the first substrate edge.

14. The apparatus of claim 10, the first substrate having a first substrate edge, the adjusting means comprising means for adjusting the foil slot such that the first slot end is not beyond the first substrate edge.

15. The apparatus of claim 10, the first substrate width being wider than the slot length.

16. The apparatus of claim 10, further comprising:

means for readjusting the foil slot length to correspond to a second substrate having a second substrate width, the second substrate width being different from the first substrate width;

means for applying the coating onto the second substrate to form a second coated substrate, the second substrate having the second substrate width; and means for transporting the second coated substrate through the drying path.

17. An apparatus for evaporating a coating solvent from a coating on a first substrate surface of a first substrate and minimizing the formation of mottle as the coating solvent is evaporating, the first substrate also having a second substrate surface and a first substrate width, the coating having a first coating edge and an opposite second coating edge on the first substrate, the apparatus comprising:

means for providing a drying path for the first substrate within a drying oven, the drying oven having a plurality of sources of drying gas impinging on the second substrate surface, the plurality of sources being positioned adjacent to the second substrate surface, each of the plurality of drying gas sources having a source length;

means for adjusting the source length to not be significantly greater than the first substrate width to minimize gas flow over the first and second coating edges which minimizes the creation of mottle;

means for applying the coating onto the first substrate surface of the first substrate to form a coated substrate; and means for transporting the coated substrate through the drying path.

18. The apparatus of claim 17, the plurality of sources of gas comprising at least one of an air foil, air bar, perforated plate, and an air turn.

* * * * *

UNITED STATES PATENT AND TRADEMARK OFFICE

CERTIFICATE OF CORRECTION

PATENT NO.: 5,621,983

DATED: April 22, 1997

INVENTOR(S): Ludemann et al.

It is certified that error appears in the above-identified patent and that said Letters Patent is hereby corrected as shown below:

Title page, item [19]

On the cover page, under the words "United States Patent" and after the subheading "[75] Inventors:," the name "Lundemann" should read --Ludemann--.

In column 2, line 65, "tip" should read --up--.

In column 8, line 60, "tile" should read --the--.

In column 9, line 1, "tile" should read --the--.

In column 9, line 18, "evapotable" should read --evaporable--.

In column 9, line 22, "evapotable" should read --evaporable--.

In column 12, line 46, "deflects" should read --defects--.

Signed and Sealed this

Fifth Day of May, 1998

Bruce Lehman

*Attest:*

BRUCE LEHMAN

*Attesting Officer*

*Commissioner of Patents and Trademarks*